US007591239B2

(12) United States Patent
Okamoto

(10) Patent No.: US 7,591,239 B2
(45) **Date of Patent: *Sep. 22, 2009**

(54) HIGH-PRESSURE FUEL PUMP CONTROL DEVICE FOR ENGINE

(75) Inventor: Takashi Okamoto, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 35 days.

This patent is subject to a terminal disclaimer.

(21) Appl. No.: 11/939,020

(22) Filed: Nov. 13, 2007

(65) Prior Publication Data

US 2008/0262700 A1 Oct. 23, 2008

Related U.S. Application Data

(63) Continuation of application No. 11/755,922, filed on May 31, 2007, now Pat. No. 7,325,536, which is a continuation of application No. 11/008,167, filed on Dec. 10, 2004, now Pat. No. 7,240,666.

(30) Foreign Application Priority Data

Dec. 12, 2003 (JP) ..... 2003-415495

(51) Int. Cl.
*F02D 41/06* (2006.01)

(52) U.S. Cl. ..... 123/179.17

(58) Field of Classification Search ..... 123/446, 123/447, 179.16, 179.17, 496
See application file for complete search history.

(56) References Cited

U.S. PATENT DOCUMENTS 6,135,090 A * 10/2000 Kawachi et al. ..... 123/446

(Continued)

FOREIGN PATENT DOCUMENTS

DE 10064055 7/2001

(Continued)

OTHER PUBLICATIONS

European Search Report dated Dec. 3, 2007.

(Continued)

*Primary Examiner*—Thomas N Moulis
(74) *Attorney, Agent, or Firm*—Crowell & Moring LLP

(57) ABSTRACT

A high-pressure fuel pump control device is capable of reducing current consumption, increasing pump durability, and promoting a rise of fuel pressure from startup. The high-pressure fuel pump control device comprises a fuel injector valve for directly injecting fuel in a common rail into a combustion chamber and a high-pressure fuel pump for feeding the fuel under pressure to the common rail. The high-pressure fuel pump comprises a pressurization chamber, a plunger for pressurizing the fuel in the pressurization chamber, a fuel passage valve disposed in the pressurization chamber, and an actuator for actuating the fuel passage valve. The control device includes a control unit for executing output control of a drive signal for the actuator to vary a discharge rate of the high-pressure fuel pump. The control unit starts outputting of the actuator drive signal during a period from operation start to a point in time at which the actuator drive signal becomes able to issue in a predetermined crank angle phase, and sets timing of stopping the outputting of the actuator drive signal to a point in time at which the fuel pressure in the common rail has boosted over a predetermined value per unit time.

15 Claims, 19 Drawing Sheets

U.S. PATENT DOCUMENTS

| | | | | |
|---|---|---|---|---|
| 6,167,870 | B1 * | 1/2001 | Sakasai | 123/500 |
| 6,237,573 | B1 * | 5/2001 | Onishi et al. | 123/506 |
| 6,257,204 | B1 * | 7/2001 | Kamijo et al. | 123/456 |
| 6,314,945 | B1 * | 11/2001 | Sugiyama et al. | 123/506 |
| 6,318,343 | B1 * | 11/2001 | Nakagawa et al. | 123/500 |
| 6,336,445 | B1 * | 1/2002 | Yamazaki et al. | 123/506 |
| 6,394,072 | B1 * | 5/2002 | Yoshida et al. | 123/506 |
| 6,526,947 | B2 * | 3/2003 | Shimada et al. | 123/495 |
| 6,745,751 | B2 * | 6/2004 | Seo et al. | 123/456 |
| 6,899,084 | B2 * | 5/2005 | Miyashita | 123/446 |
| 6,953,025 | B2 * | 10/2005 | Takahashi | 123/497 |
| 7,028,667 | B2 * | 4/2006 | Hori | 123/446 |
| 7,240,666 | B2 * | 7/2007 | Okamoto | 123/446 |
| 7,299,790 | B2 * | 11/2007 | Okamoto et al. | 123/506 |
| 7,325,536 | B2 * | 2/2008 | Okamoto | 123/446 |

FOREIGN PATENT DOCUMENTS

| | | |
|---|---|---|
| EP | 1249599 | 10/2002 |
| JP | 2-146256 | 6/1990 |
| JP | 10-61468 | 3/1998 |
| JP | 2001-182597 | 7/2001 |
| JP | 2003-041982 | 2/2003 |

OTHER PUBLICATIONS 2 sheets of Form PTO-1449 and 2 sheets of Form PTO-892.

* cited by examiner

HIGH-PRESSURE FUEL PUMP CONTROL DEVICE FOR ENGINE

This application is a continuation of prior U.S. patent application Ser. No. 11/755,922, filed May 31, 2007, the entire disclosure of which is incorporated herein by reference, which is a continuation of Ser. No. 11/008,167, filed Dec. 10, 2004, now U.S. Pat. No. 7,240,666, issued Jul. 10, 2007, the entire disclosure of which is also incorporated herein by reference, and further claims priority under 35 U.S.C. 119 to prior Japanese Patent application 2003-415-495, filed Dec. 12, 2003.

BACKGROUND OF THE INVENTION

1. Field of the Invention

The present invention relates to a high-pressure fuel pump control device for an engine, and more particularly to a high-pressure fuel pump control device capable of variably adjusting a discharge amount of high-pressure fuel that is fed under pressure to a fuel injector valve.

2. Description of the Related Art

From the viewpoint of environmental protection, there are at present a demand in the field of automobiles for reducing particular substances contained in automobile exhaust gas, such as carbon monoxide (CO), hydrocarbons (HC), and nitrogen oxides (NOx), i.e., for improving exhaust emission characteristics and enhancing fuel economy. To meet such a demand, a direct injection engine (in-cylinder injection engine) is under development. In the direct injection engine, improvements in exhaust emission characteristics and hence in engine output are intended by directly injecting fuel from a fuel injector valve into a combustion chamber of each cylinder so that the fuel is injected in smaller particle size from the fuel injector valve and combustion of the injected fuel is promoted.

To make smaller the particle size of the fuel injected from the fuel injector valve, some means for pressurizing the fuel to a high-pressure level is required, and a high-pressure fuel pump for feeding the high-pressure fuel to the fuel injector valve is used as such a means.

One example of known high-pressure fuel pumps comprises a pressurization chamber, a plunger for pressurizing fuel in the pressurization chamber, a fuel passage valve (inlet valve) disposed in the pressurization chamber, and an actuator for actuating the fuel passage valve. In a discharge stroke (plunger rising stroke), the fuel passage valve is closed to feed the fuel under pressure to a common rail (fuel accumulation chamber).

In control of such a high-pressure fuel pump, the timing of closing the fuel passage valve is set depending on the fuel pressure, and a solenoid drive signal (pulse), i.e., an actuator drive signal, is outputted under angle or time control at the set timing on the basis of a REF signal produced from both a cam angle signal and a crank angle sensor, thereby closing the fuel passage valve.

Just after the start of engine operation (i.e., the start of cranking), however, the phases of a cam angle and a crank angle are not definite, and the REF signal is not produced. Accordingly, it is impossible to set the timing of closing the fuel passage valve. For that reason, various techniques are proposed on control of the high-pressure fuel pump just after the operation start, i.e., for a period from the operation start to a point in time at which the phases of the cam angle and the crank angle become definite.

For example, JP-A-2001-182597 (pp. 1-24, FIGS. 1 to 22) discloses a technique of outputting the actuator drive signal (pulse) at least two times during a period from recognition of the crank angle signal to the point in time at which the phases of the cam angle and the crank angle become definite, i.e., during a period from the operation start to the point in time at which it becomes possible to output the actuator drive signal in a predetermined crank angle phase.

Also, JP-A-2003-41982 (pp. 1-13, FIGS. 1 to 9) discloses a technique of, at operation start of an in-cylinder injection engine including a high-pressure fuel pump operatively coupled to a crankshaft, performing duty control of power supply to a spill valve of the high-pressure fuel pump at a cycle of very short time before the timing at which the crank angle phase becomes definite, and stopping the fuel pressure control with such duty control after the crank angle phase has become definite. Thereafter, the timing of starting the spill valve to close is set to predetermined timing, and the spill valve is closed at the set predetermined timing of starting the valve closing, to thereby boost the fuel pressure. The timing of switching the fuel pressure control from the former mode to the latter mode is set so as to cover a period from just after the start of a discharge stroke of the high-pressure fuel pump to the timing that has been computed as the predetermined timing of starting the valve closing.

SUMMARY OF THE INVENTION

In the high-pressure fuel pump control device disclosed in JP-A-2001-182597, because the actuator drive signal (pulse) is essentially outputted several times during the period from the operation start to the point in time at which the phases of the cam angle and the crank angle become definite, an energization time of the actuator in the high-pressure fuel pump is prolonged and current consumption is increased. In addition, there is a risk that a solenoid as one component of the actuator is more susceptible to a thermal damage or other troubles, and durability of the actuator deteriorates.

Also, the technique disclosed in JP-A-2003-41982 is intended to avoid missing of fuel feed under pressure from the high-pressure fuel pump during the engine startup, and to employ the crank angle signal to set the timing of changing the control mode for that purpose. When the high-pressure fuel pump is operatively coupled to a camshaft, the duty control must be performed at a cycle of very short time to ensure positive boosting of the fuel pressure, as described above, while the control period is set taking into account maximum variations in mounting of the crankshaft and a pump driving cam. In the case where actual variations are small, extra signals are outputted and current consumption is increased.

Further, each of the above-cited Patent References suggests that, because control cannot be performed at the set timing of starting the valve closing before the crank angle phase becomes definite, other type of control than the timing control is performed by using some means for setting the drive signal. However, a particular consideration is not paid to determination as to whether the other type of control is performed before the crank angle phase becomes definite. Additionally, any of the above-described known techniques has a possibility that, because the pump discharge stroke includes a period for outputting a valve opening signal (to turn off the driving output) for the purpose of duty control, the pump inlet valve may fail to close, namely the positive pressure boosting is not ensured.

In view of the above-mentioned problems with the known techniques, it is an object of the present invention to provide a high-pressure fuel pump control device for an engine, which can positively control the pressure of fuel supplied to a fuel injector valve to kept at a target fuel pressure, which can realize satisfactory combustion and improvements in exhaust emission characteristics and fuel consumption, and which can increase durability of the high-pressure fuel pump and reduce current consumption thereof.

To achieve the above object, the high-pressure fuel pump control device according to the present invention is basically applied to an engine, comprising a fuel injector valve for directly injecting fuel in a common rail into a combustion chamber and a high-pressure fuel pump for feeding the fuel under pressure to the common rail, the high-pressure fuel pump comprising a pressurization chamber, a plunger for pressurizing the fuel in the pressurization chamber, a fuel passage valve disposed in the pressurization chamber, and an actuator for actuating the fuel passage valve. The high-pressure fuel pump control device includes a control unit for executing output control of a drive signal for the actuator to vary a discharge rate of the high-pressure fuel pump, and the control unit starts outputting of the actuator drive signal during a period from operation start to a point in time at which the actuator drive signal becomes able to issue in a predetermined crank angle phase, and sets timing of stopping the outputting of the actuator drive signal based on fuel pressure in the common rail.

In a preferable form, the control unit stops the outputting of the actuator drive signal when the fuel pressure in the common rail has boosted over a predetermined value per unit time, or when a pressure difference with respect to the pressure at the operation start has exceeded a predetermined value.

Preferably, the control unit stops the outputting of the actuator drive signal when a crank angle signal has been recognized in excess of a predetermined number of times.

Preferably, the control unit sets the predetermined number of times based on a battery voltage.

Preferably, the control unit stops the outputting of the actuator drive signal when a predetermined period has lapsed from the start of outputting of the actuator drive signal.

Preferably, the control unit sets the timing of stopping the outputting of the actuator drive signal based on a crank angle signal or a cam angle signal which indicates a discharge range of the high-pressure fuel pump.

In another preferable form of the high-pressure fuel pump control device according to the present invention, the control unit starts outputting of the actuator drive signal during a period from operation start to a point in time at which the actuator drive signal becomes able to issue in a predetermined crank angle phase, when a crank angle signal has been recognized in excess of a predetermined number of times from the operation start.

Preferably, the control unit starts the outputting of the actuator drive signal when the fuel pressure in the common rail is below a predetermined value.

Preferably, the control unit starts the outputting of the actuator drive signal when temperature of engine cooling water is below a predetermined value.

Preferably, the control unit starts the outputting of the actuator drive signal when a predetermined period has lapsed from stop of the preceding outputting of the actuator drive signal.

Preferably, the control unit sets the predetermined period based on a preceding output time of the actuator drive signal and/or a crank angle demanded value.

Preferably, the control unit sets the timing of starting the outputting of the actuator drive signal based on the crank angle signal or a cam angle signal which indicates a discharge range of the high-pressure fuel pump.

In still another preferable form of the high-pressure fuel pump control device according to the present invention, the control unit continuously outputs the actuator drive signal for a predetermined time during a period from operation start to a point in time at which the actuator drive signal becomes able to issue in a predetermined crank angle phase.

With the high-pressure fuel pump control device for the engine according to the present invention, the outputting of the solenoid drive signal is started during the period from the operation start to the point in time at which it becomes possible to output the solenoid drive signal in the predetermined crank angle phase. Also, the outputting of the solenoid drive signal is stopped when the fuel pressure in the common rail has boosted over the predetermined value per unit time, or when a pressure difference with respect to the pressure at the operation start has exceeded a predetermined value. Therefore, the fuel pressure can be positively boosted to a required level, and satisfactory combustion is realized with improved robustness. Further, a total energization time of the solenoid at the startup can be cut as compared with the known techniques. It is hence possible to increase durability of the high-pressure fuel pump and to reduce current consumption.

In addition, since the output start timing of the solenoid drive signal is delayed from the operation start timing, it is possible to further cut the total energization time of the solenoid, increase durability of the high-pressure fuel pump, and reduce current consumption.

DESCRIPTION OF THE PREFERRED EMBODIMENTS

Embodiments of a high-pressure fuel pump control device for an engine according to the present invention will be described below with reference to the drawings.

Figure 1:
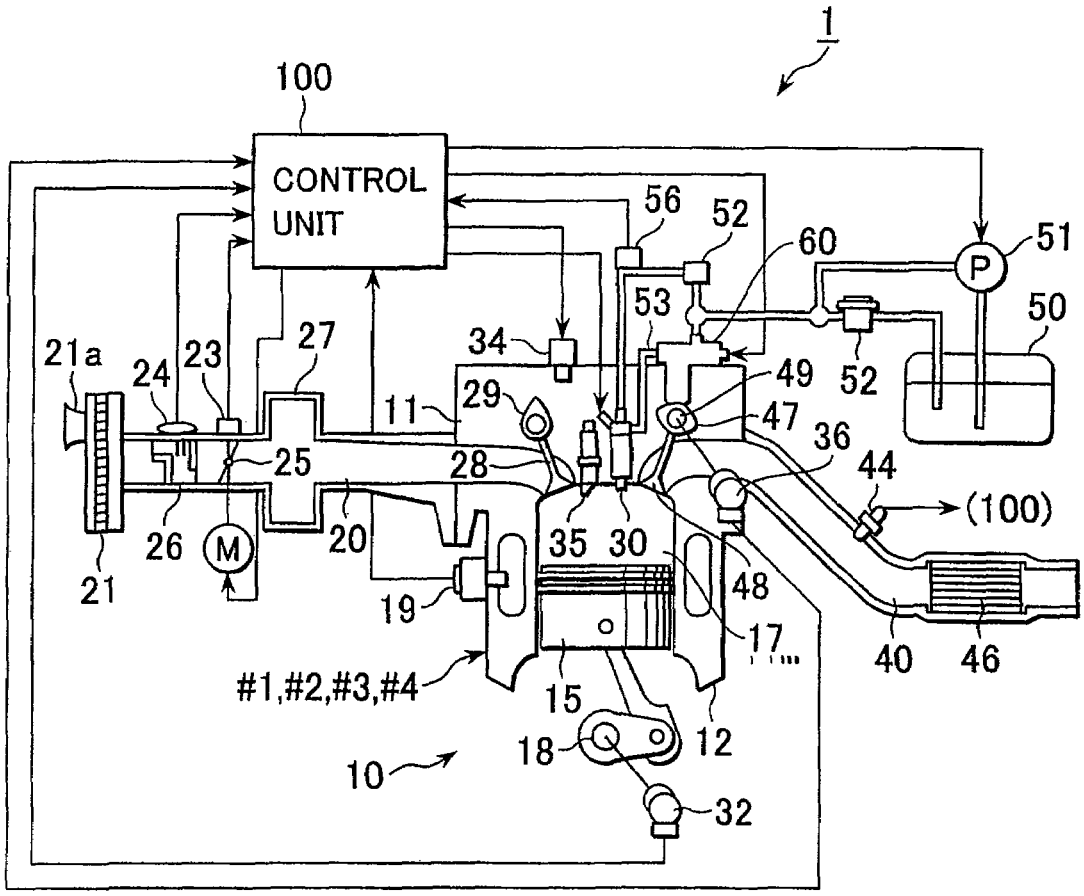
FIG. 1 is an overall schematic view of one embodiment of a high-pressure fuel pump control device according to the present invention, along with an engine to which the high-pressure fuel pump control device is applied.

FIG. 1 is an overall schematic view of one embodiment of the high-pressure fuel pump control device according to the present invention, along with one example of a vehicle-loaded in-cylinder injection engine to which the high-pressure fuel pump control device is applied.

An in-cylinder injection engine 10 shown in FIG. 1 is, for example, a 4-cylinder in-line engine having four cylinders #1, #2, #3 and #4. The in-cylinder injection engine 10 comprises a cylinder head 11, a cylinder block 12, and a piston 15 slidably fitted in the cylinder block 12. A combustion chamber 17 is defined above the piston 15. An ignition plug 35 supplied with a high voltage from an ignition coil 34 and a fuel injector valve 30 for directly injecting fuel into the combustion chamber 17 are disposed so as to face the combustion chamber 17. While the ignition plug 35 and the fuel injector valve 30 are shown as being disposed at the ceiling of the combustion chamber 17 side by side in the left-and-right direction for the sake of convenience in drawing, layout of those components can be optionally set.

Air to be supplied for combustion of the fuel is taken in through an inlet 21*a* of an air cleaner 21 disposed at an entrance end of an intake passage 20. After passing an airflow sensor 24, the taken-in air enters a collector 27 through a throttle body 26 in which an electronically controlled throttle valve 25 is disposed. Then, the air is introduced from the collector 27 to the combustion chamber 17 of each of the cylinders #1, #2, #3 and #4 through a branched passage, serving as a downstream portion of the intake passage 20, and an intake valve 28 that is opened and closed by an intake camshaft 29 disposed at a downstream end of the branched passage.

An air-fuel mixture of the air taken into the combustion chamber 17 and the fuel injected into it from the fuel injector valve 30 is ignited by the ignition coil 35 for explosion and combustion. Resulting combustion waste gas (exhaust gas) is exhausted to an exhaust passage 40 through an exhaust valve 48 that is opened and closed by an exhaust camshaft 49. Then, the exhaust gas is cleaned through a catalyst converter 46 disposed in the exhaust passage 40, followed by being exhausted to the exterior.

On the other hand, the fuel, such as gasoline, injected from the fuel injector valve 30 is supplied from a fuel tank 50 under primary pressurization made by a low-pressure fuel pump 51 and is regulated to a constant pressure (e.g., 3 kg/cm$^2$) by a fuel pressure regulator 52. Then, the fuel is further pressurized to a higher pressure level through secondary pressurization (e.g., 50 kg/cm$^2$) made by a high-pressure fuel pump 60 that is driven by a pump driving cam 47 mounted to an exhaust camshaft 49. The fuel is thus fed to a common rail (fuel accumulation chamber) 53, and is supplied from the common rail 53 to the fuel injector valve 30 provided for each of the cylinders #1, #2, #3 and #4. The pressure of the fuel supplied to the fuel injector valve 30 (i.e., the fuel pressure) is detected by a fuel pressure sensor 56 (as described in detail later).

Further, a high-pressure fuel pump control device 1 of this embodiment includes a control unit 100 in which a microcomputer is incorporated to execute various kinds of control for the engine 10 including the high-pressure fuel pump 60.

Figure 2:
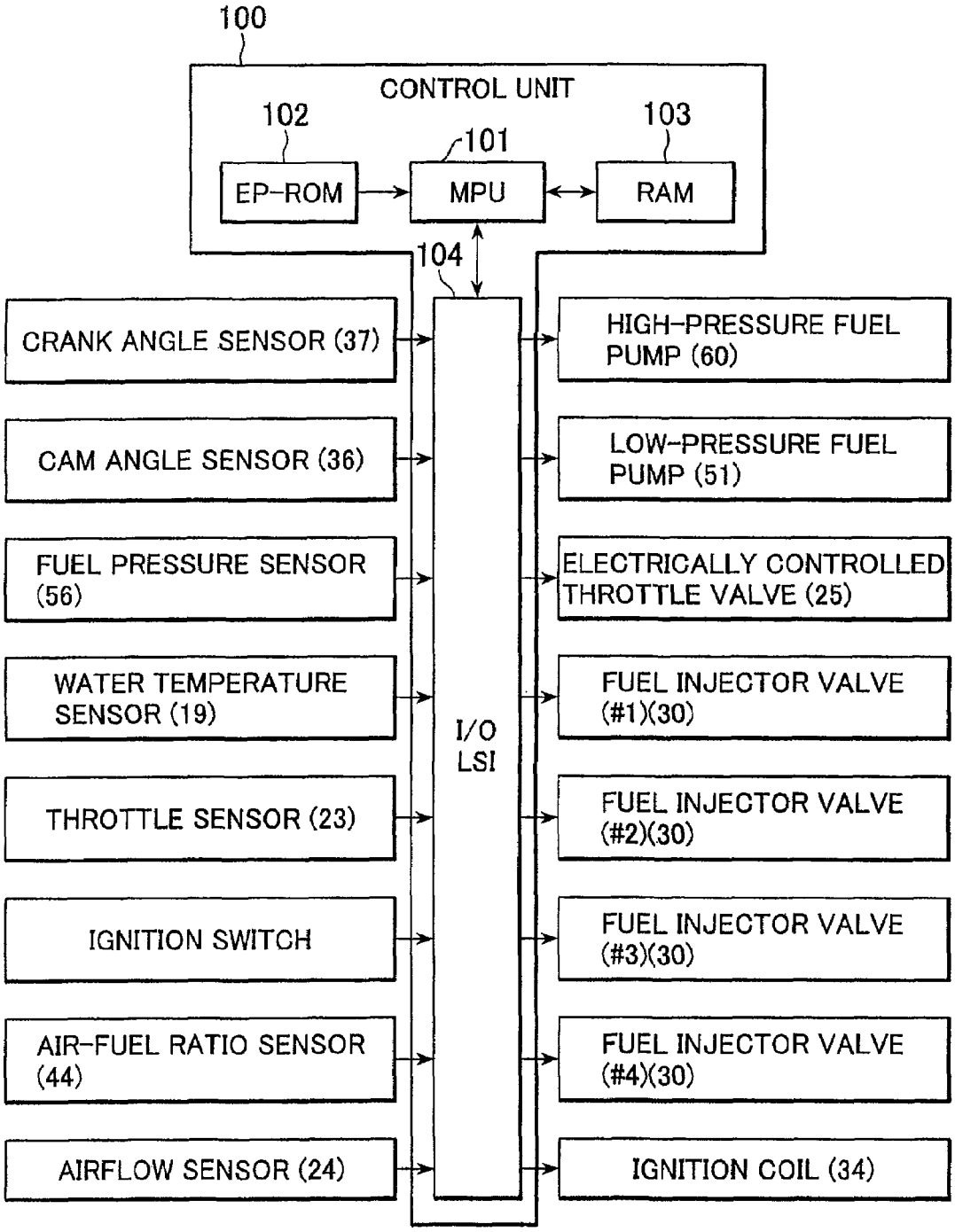
FIG. 2 is a block diagram for explaining a control unit constituting a primary part of the high-pressure fuel pump control device shown in FIG. 1.

As shown in FIG. 2, the control unit 100 basically comprises an MPU 101, an EP-ROM 102, a RAM 103, an I/O LSI 104 including an A/D converter, etc. The control unit 100 receives, as input signals, a signal corresponding to the air intake detected by the airflow sensor 24, a signal corresponding to the fuel pressure detected by the fuel pressure sensor 56, a signal corresponding to the opening degree of the throttle valve 25 detected by a throttle sensor 23, a phase (rotational position) detected signal of the exhaust camshaft 49 from a cam angle sensor 36, a rotational angle/phase (rotational position) detected signal of the crankshaft 18 from a crank angle sensor 37, a signal corresponding to, e.g., the oxygen concentration in exhaust gas detected by an air-fuel ratio sensor 44 that is disposed in the exhaust passage 40, a signal corresponding to the engine cooling water temperature detected by a water temperature sensor 19 that is disposed in the cylinder block 12, a signal indicating the start of engine operation (i.e., the start of cranking) from an ignition switch not shown in FIG. 1, etc.

The control unit 100 takes in the above-mentioned signals at a predetermined cycle, executes predetermined processing, and supplies control signals, which are computed as processing results, to each fuel injector valve 30, the ignition coil 34, the high-pressure fuel pump 60, the low-pressure fuel pump 51, electronically controlled throttle valve 25 and so on, thereby executing fuel injection (injection amount and injection timing) control, ignition timing control, fuel pressure control, opening degree control of the throttle valve 25, etc.

The high-pressure fuel pump control device 1 of this embodiment is featured in output control of a control (driving) signal for an actuator (solenoid 90) disposed in the high-pressure fuel pump 60. That feature will be described in more detail below.

Figure 3:
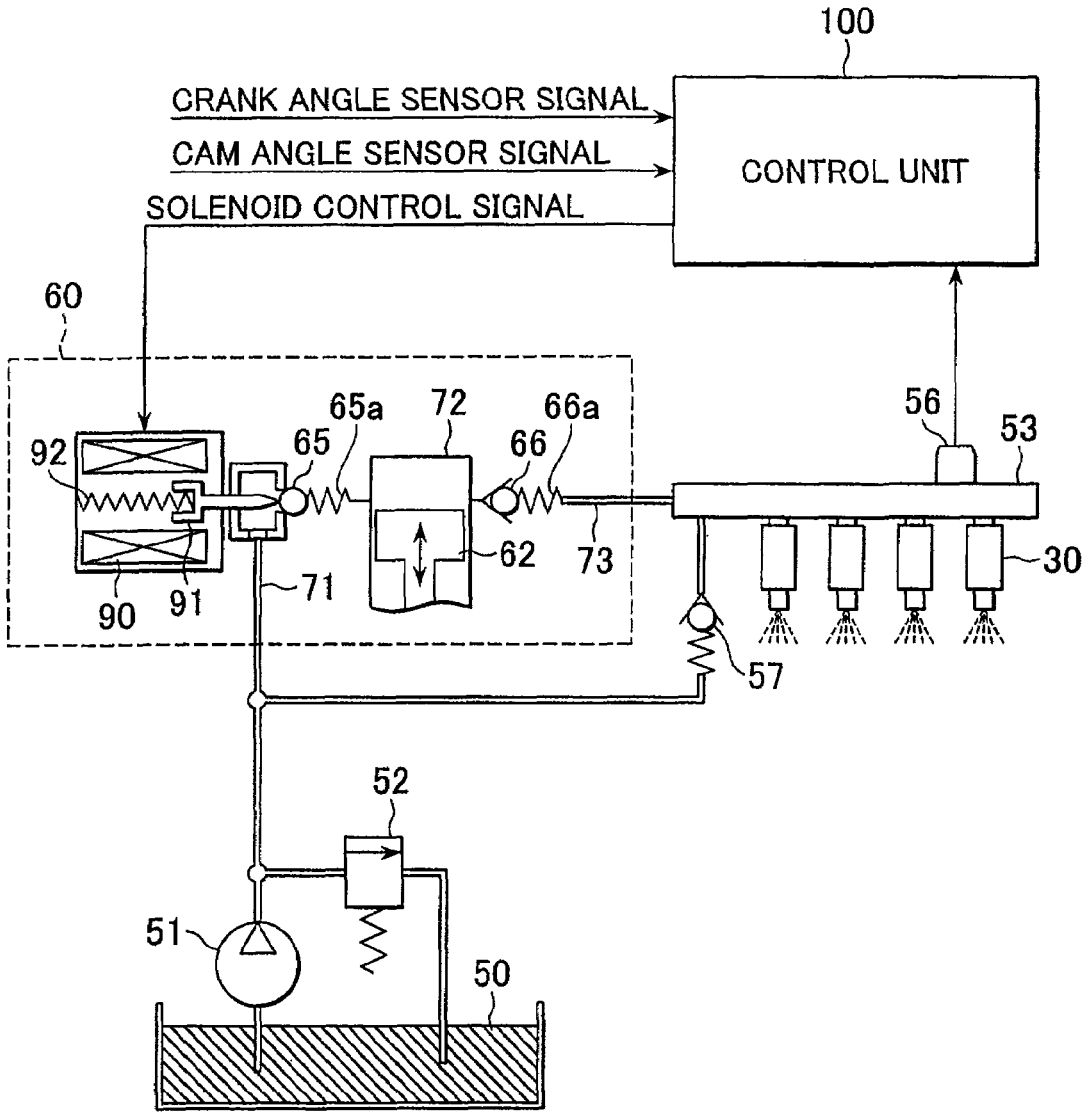
FIG. 3 is an overall schematic view of a fuel supply system equipped with a high-pressure fuel pump.
Figure 4:
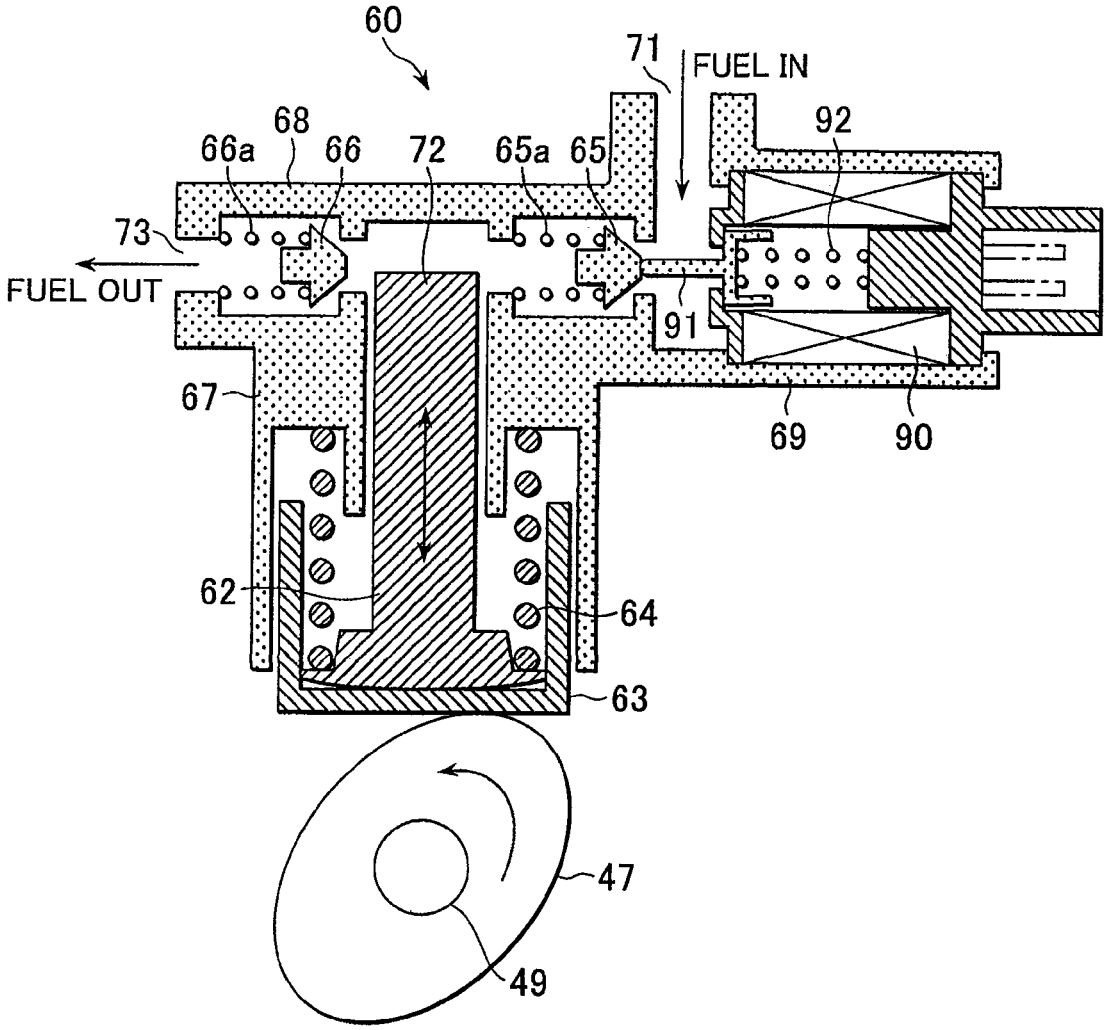
FIG. 4 is an enlarged vertical sectional view of the high-pressure fuel pump shown in FIG. 1.

FIG. 3 is an overall schematic view of a fuel supply system equipped with the high-pressure fuel pump 60, and FIG. 4 is an enlarged vertical sectional view of the high-pressure fuel pump 60.

The high-pressure fuel pump 60 pressurizes the fuel supplied from the fuel tank 50 and feeds the fuel under high pressure to the common rail 53. The high-pressure fuel pump 60 comprises a cylinder chamber 67, a pump chamber 68, and a solenoid chamber 69. The cylinder chamber 67 is positioned below the pump chamber 68, and the solenoid chamber 69 is positioned on the inlet side of the pump chamber 68.

A plunger 62, a lifter 63, and a plunger lowering spring 64 are disposed in the cylinder chamber 67. The plunger 62 is moved in a reciprocal manner through the lifter 63 held in pressure contact with the pump driving cam 47 that is mounted to the exhaust camshaft 49 for rotation together with the shaft 49, thereby changing the volume of a pressurization chamber 72.

The pump chamber 68 comprises a low-pressure fuel inlet passage 71, the pressurization chamber 72, and a high-pressure fuel discharge passage 73. An inlet valve 65 serving as a fuel passage valve is disposed between the inlet passage 71 and the pressurization chamber 72. The inlet valve 65 is a check valve for limiting the direction of flow of the fuel, and is biased in the valve closing direction (i.e., the direction toward the solenoid chamber 69 from the pump chamber 68) by a valve closing spring 65*a*. A discharge valve 66 is disposed between the pressurization chamber 72 and the discharge passage 73. The discharge valve 66 is also a check valve for limiting the direction of flow of the fuel, and is biased in the valve closing direction by a valve closing spring 66*a*. The valve closing spring 65*a* biases the inlet valve 65 so as to close when the pressure on the pressurization chamber 72 side, i.e., one side of the inlet valve 65, becomes equal to or higher than the pressure on the inlet passage 71 side, i.e., the other side of the inlet valve 65, with change in the volume of the pressurization chamber 72 caused by the operation of the plunger 62.

The solenoid 90 serving as an actuator, an inlet valve actuating member 91, and a valve opening spring 92 are disposed in the solenoid chamber 69. The inlet valve actuating member 91 is disposed in a position opposite to the inlet valve 65, and has a fore end (rod end) capable of coming into contact with or moving away from the inlet valve 65. When the solenoid 90 is excited with energization, the inlet valve actuating member 91 is attracted toward the solenoid chamber 69 side by an electromagnetic force produced by the solenoid 90, whereupon the inlet valve 65 is moved in the valve closing direction. On the other hand, when the solenoid 90 is not excited with energization, the inlet valve 65 is moved in the valve opening direction through the inlet valve actuating member 91 by a biasing force of the valve opening spring 92 that is held in pressure contact with a rear end of the inlet valve actuating member 91. As a result, the inlet valve 65 is opened.

The fuel supplied from the fuel tank 50 while being regulated to the predetermined pressure through the fuel pump 51 and the fuel pressure regulator 52 is introduced to the inlet passage 71 of the pump chamber 68. Then, the fuel is pressurized in the pressurization chamber 72 within the pump chamber 68 with the reciprocal motion of the plunger 62 so that the fuel is fed under high pressure to the common rail 53 through the discharge passage 73 of the pump chamber 68.

The pressure sensor 56 is disposed in the common rail 53. In accordance with the detected signals from the crank angle sensor 37, the cam angle sensor 36, and the fuel sensor 56, the control unit 100 outputs the control (driving) signal for the solenoid 90 and controls the amount of the fuel discharged from the high-pressure fuel pump 60. Additionally, a relief valve 57 is disposed between the common rail 53 and the fuel tank 50 for the purpose of preventing breakage of a piping system. The relief valve 57 is opened when the pressure in the common rail 53 exceeds a predetermined value.

Figure 5:
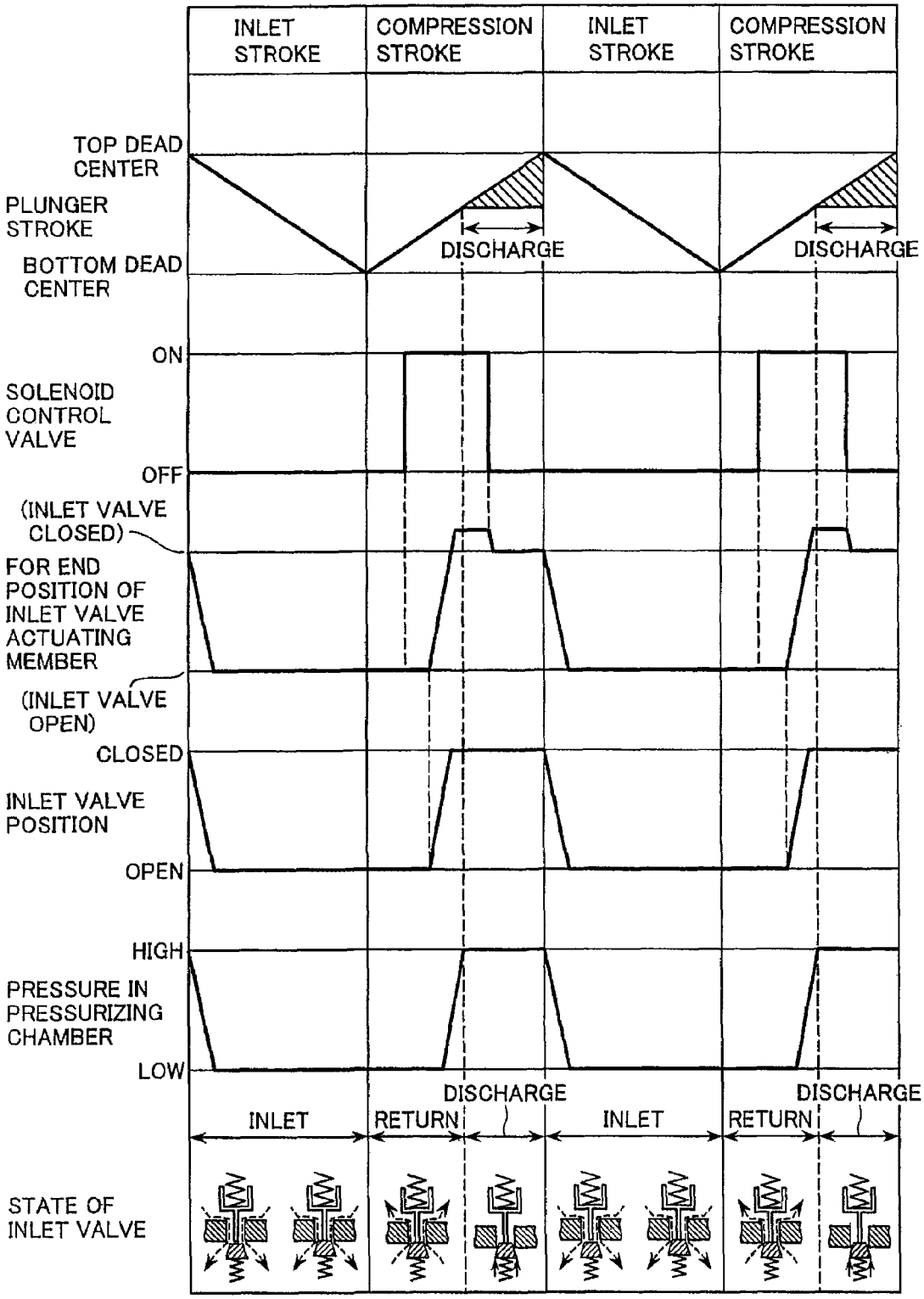
FIG. 5 is a time chart for explaining the operation of the high-pressure fuel pump.
Figure 6:
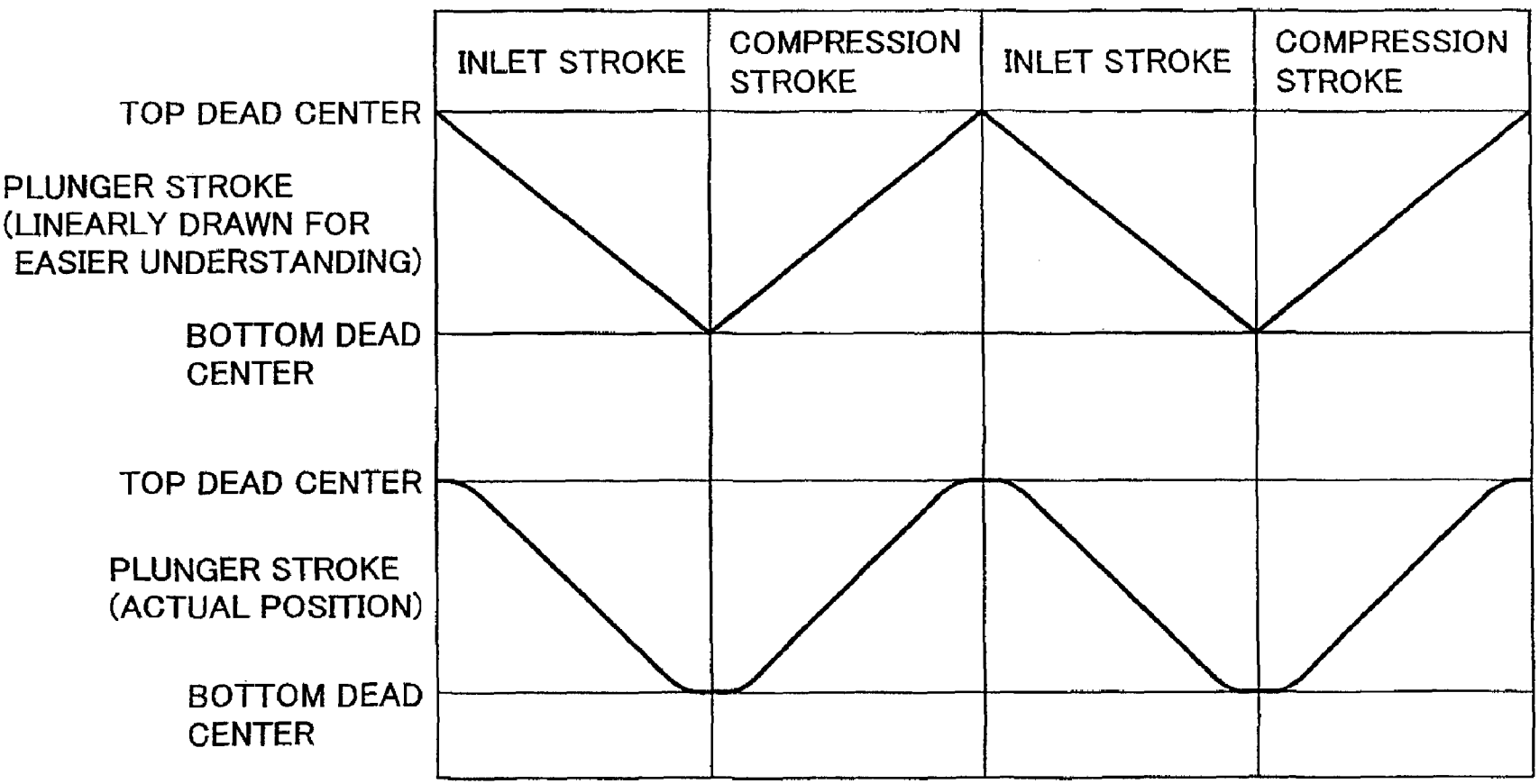
FIG. 6 is a time chart for supplement explanation in relation to the time chart of FIG. 5.

FIG. 5 is a time chart for explaining the operation of the high-pressure fuel pump 60. An actual stroke (actual position) of the plunger 62 driven by the pump driving cam 47 is represented by a curved line as shown in a lower stage of FIG. 6. For easier understanding of positions of the top dead center and the bottom dead center, however, the stroke of the plunger 62 is drawn linearly in figures (i.e., FIGS. 5, 9, 10, 17, 18 and 19), in which the stroke of the plunger 62 is shown, other than FIG. 6.

When the plunger 62 is moved from the top dead center side toward the bottom dead center side by a biasing force of the plunger lowering spring 64 with the rotation of the pump driving cam 47, an inlet stroke takes place in the pump chamber 68. In this inlet stroke, the inlet valve actuating member 91 moves the inlet valve 65 in the valve opening direction by the biasing force of the valve opening spring 92. As a result, the pressure in the pressurization chamber 72 lowers.

Next, when the plunger 62 is moved from the bottom dead center side toward the top dead center side against the biasing force of the plunger lowering spring 64 with the rotation of the pump driving cam 47, a compression stroke takes place in the pump chamber 68. In this compression stroke, the control unit 100 outputs the drive signal for the solenoid 90, serving as the actuator, to bring the solenoid 90 into an excited state (i.e., an on-state), whereupon the inlet valve actuating member 91 is moved against the biasing force of the valve opening spring 92 in the direction to close the inlet valve 65. Correspondingly, the fore end of the inlet valve actuating member 91 moves away from the inlet valve 65, and the inlet valve 65 is moved in the valve closing direction by the biasing force of the valve closing spring 65*a*. As a result, the pressure in the pressurization chamber 72 rises.

Then, when the inlet valve actuating member 91 is maximally attracted toward the solenoid 90 side and the pressure in the pressurization chamber 72 reaches a high level with the inlet valve 65 closed in sync with the reciprocal motion of the plunger 62, the fuel in the pressurization chamber 72 pushes the discharge valve 66. Therefore, the discharge valve 66 is automatically opened against a biasing force of the valve closing spring 66*a*, and the high-pressure fuel is discharged to the common rail 53 side in an amount corresponding to a reduction in the volume of the pressurization chamber 72. Although the energization of the solenoid 90 (i.e., outputting of the drive signal to it) is stopped (turned off) when the inlet valve 65 is closed with the movement toward the solenoid 90 side, the inlet valve 65 remains in its closed state because the pressure in the pressurization chamber 72 is high. Thus, the fuel is continuously discharged to the common rail 53 side.

Further, when the plunger 62 is moved from the top dead center side toward the bottom dead center side by the biasing force of the plunger lowering spring 64 with the continued rotation of the pump driving cam 47, the inlet stroke takes place again in the pump chamber 68, and the pressure in the pressurization chamber 72 lowers. Therefore, the inlet valve actuating member 91 is moved by the biasing force of the valve opening spring 92 in the direction to open the inlet valve 65. As a result, the inlet valve 65 is automatically opened in sync with the reciprocal motion of the plunger 62 and is held in its open state. The discharge valve 66 is returned to its closed state and kept from opening because the pressure in the pressurization chamber 72 becomes low. Thereafter, the above-described operation is repeated.

Thus, when the solenoid 90 is turned on (energized into the excited state) during the compression stroke before the plunger 62 reaches the top dead center, the fuel is fed under high pressure to the common rail 53. Once the high-pressure feed of the fuel starts, because the pressure in the pressurization chamber 72 is at a boosted level, the inlet valve 65 remains in the closed state even after the solenoid 90 is turned off thereafter. On the other hand, the inlet valve 65 can be automatically opened in sync with the start of the inlet stroke. Therefore, the amount of the fuel discharged to the common rail 53 can be adjusted in accordance with the timing at which the outputting of the drive signal for the solenoid 90 is started. Further, by setting the output start timing based on the signal from the pressure sensor 56 so as to control the solenoid 90, the pressure in the common rail 53 can be feedback-controlled to a target value.

Figure 7:
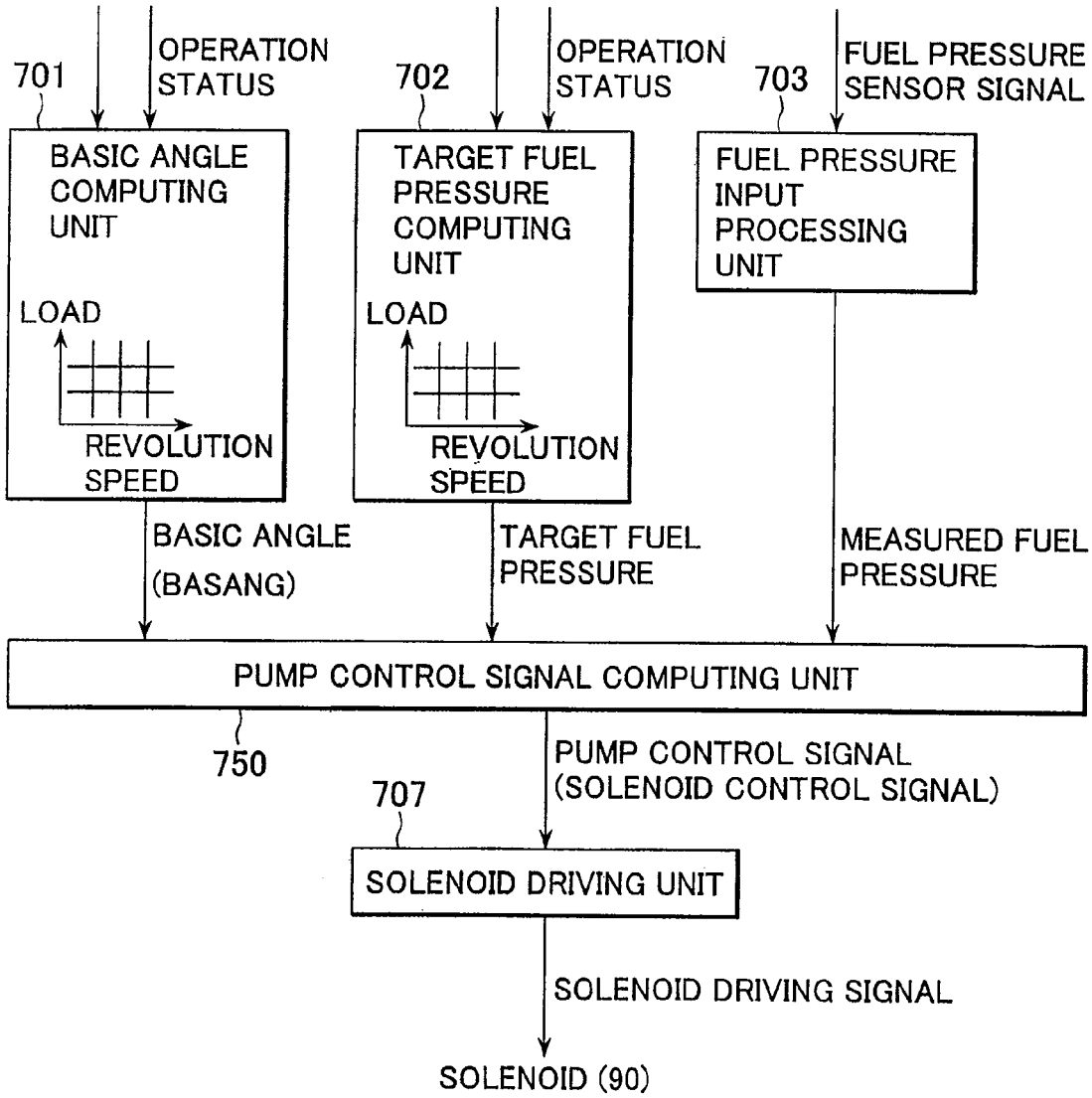
FIG. 7 is a functional block diagram for high-pressure fuel pump control executed by the control unit.

FIG. 7 is a functional block diagram for high-pressure fuel pump control executed by the control unit 100. The control unit 100 comprises a basic angle computing unit 701, a target fuel pressure computing unit 702, a fuel pressure input processing unit 703, a pump control signal computing unit 750 as one example of means for computing a solenoid control signal, and a solenoid driving unit 707 for outputting a drive signal to energize the solenoid 90 for excitation.

Figure 11:
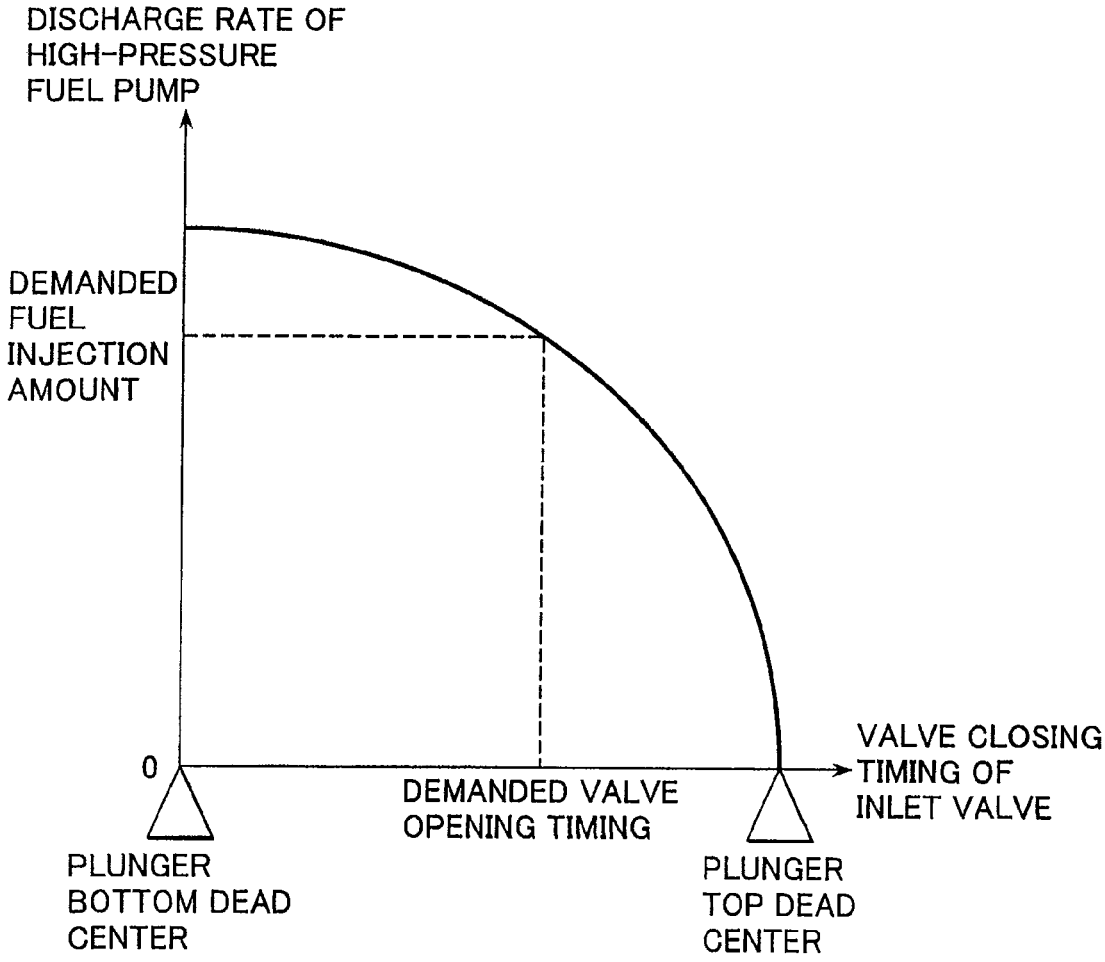
FIG. 11 is a graph showing a discharge flow rate characteristic of the high-pressure fuel pump.

The basic angle computing unit 701 computes, based on the operation status, a basic angle BASANG of the solenoid control signal for bringing the solenoid 90 into the excited state (i.e., the on-state). FIG. 11 shows the relationship between the valve closing timing of the inlet valve 65 and the discharge rate of the high-pressure fuel pump 60. The basic angle BASANG is used to set the valve closing timing (crank angle) of the inlet valve 65 for balancing the demanded fuel injection amount and the discharge rate of the high-pressure fuel pump 60 with each other. The target fuel pressure computing unit 702 computes, also based on the operation status, a target fuel pressure Ptarget optimum for the relevant operation point. The fuel pressure input processing unit 703 executes filtering of the signal from the fuel sensor 56 to determine a measured fuel pressure Preal as a real fuel pressure. The pump control signal computing unit 750 computes a pump control signal (solenoid control signal) based on the basic angle BASANG, the target fuel pressure Ptarget, and the measured fuel pressure Preal. The solenoid driving unit 707 outputs a solenoid drive signal to energize the solenoid 90 for excitation in accordance with the solenoid control signal from the pump control signal computing unit 750 (as described in detail later).

Figure 8:
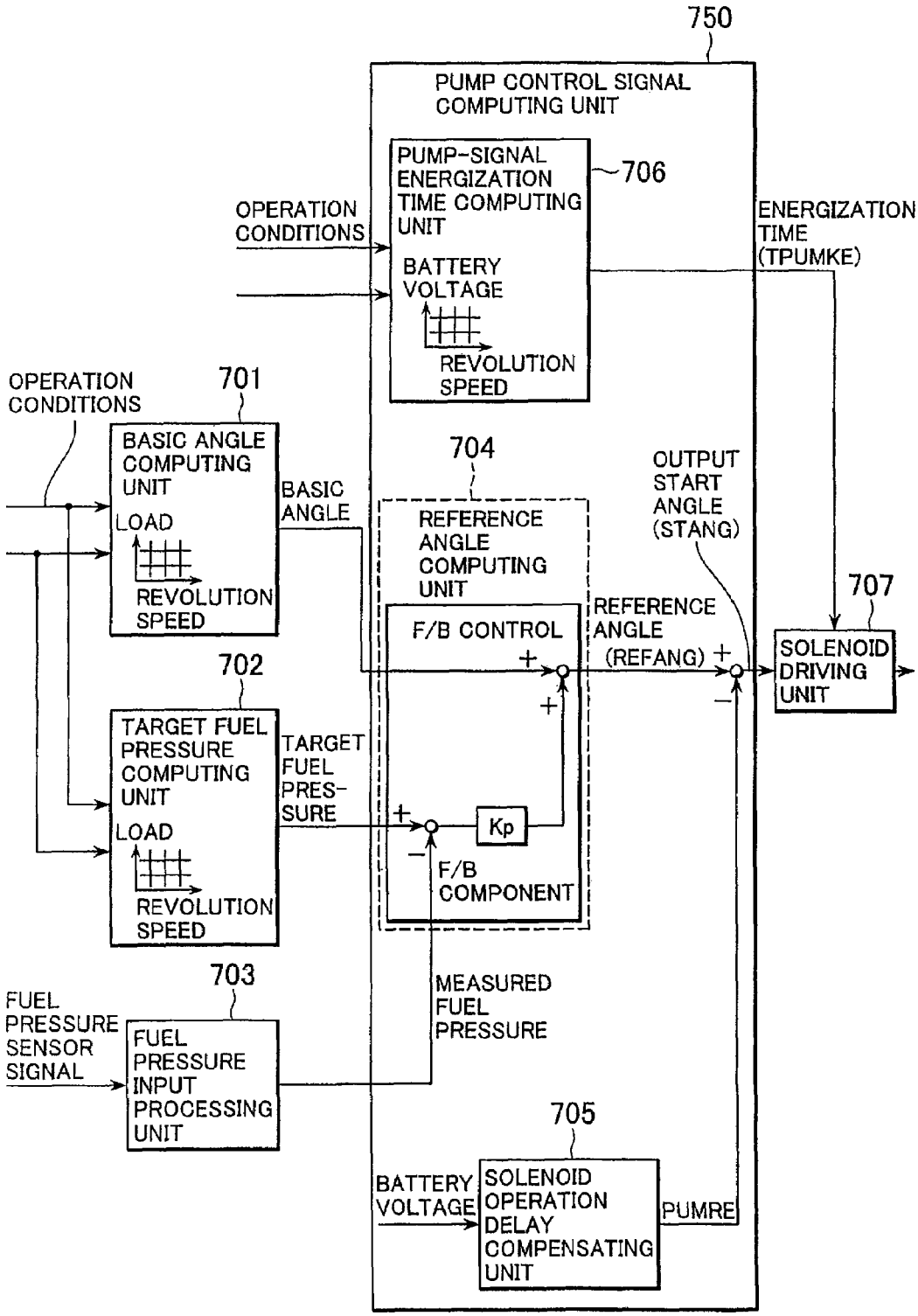
FIG. 8 is a functional block diagram showing more detailed configuration of a pump control signal computing unit shown in FIG. 7.

FIG. 8 is a functional block diagram showing more detailed configuration of the pump control signal computing unit 750. The pump control signal computing unit 750 basically comprises a reference angle computing unit 704 for computing the output start timing of the drive signal (pulse) for the solenoid 90, and a pump-signal energization time computing unit 706 for computing a duration of the drive signal (i.e., pulse width=energization time). The reference angle computing unit 704 computes a reference angle REFANG, which serves as a reference for the output start timing of the drive signal, based on the basic angle BASANG computed by the basic angle computing unit 701, the target fuel pressure Ptarget computed by the target fuel pressure computing unit 702, and the measured fuel pressure Preal computed by the fuel pressure input processing unit 703.

Then, an output start angle STANG of the drive signal for the solenoid 90 is computed by adding, to the reference angle REFANG, an operation delay compensation PUMRE that is determined by a solenoid operation delay compensating unit 705. The computed output start angle STANG is sent, as the output start timing of the drive signal for the solenoid 90, to the solenoid driving unit 707.

Also, the pump-signal energization time computing unit 706 computes an energization time TPUMKE of the solenoid 90 in the high-pressure fuel pump 60 based on the operation conditions, and sends it to the solenoid driving unit 707. Based on the output start angle STANG and the energization time TPUMKE, the solenoid driving unit 707 outputs the drive signal to the solenoid 90 for excitation thereof. The value of the energization time TPUMKE is set such that, even in the worst conditions for generation of the solenoid attraction force in which the battery voltage is low and the solenoid resistance is large, the inlet valve actuating member 91 is held in its retracted state until the inlet valve 65 becomes able to remain closed with boosting of the pressure in the pressurization chamber 72, whereby the inlet valve 65 can be positively closed. Further, because the electromagnetic force of the solenoid 90, i.e., the solenoid operation delay time, varies depending on the battery voltage, the solenoid operation delay compensating unit 705 computes the solenoid operation delay compensation PUMRE based on the battery voltage.

Figure 9:
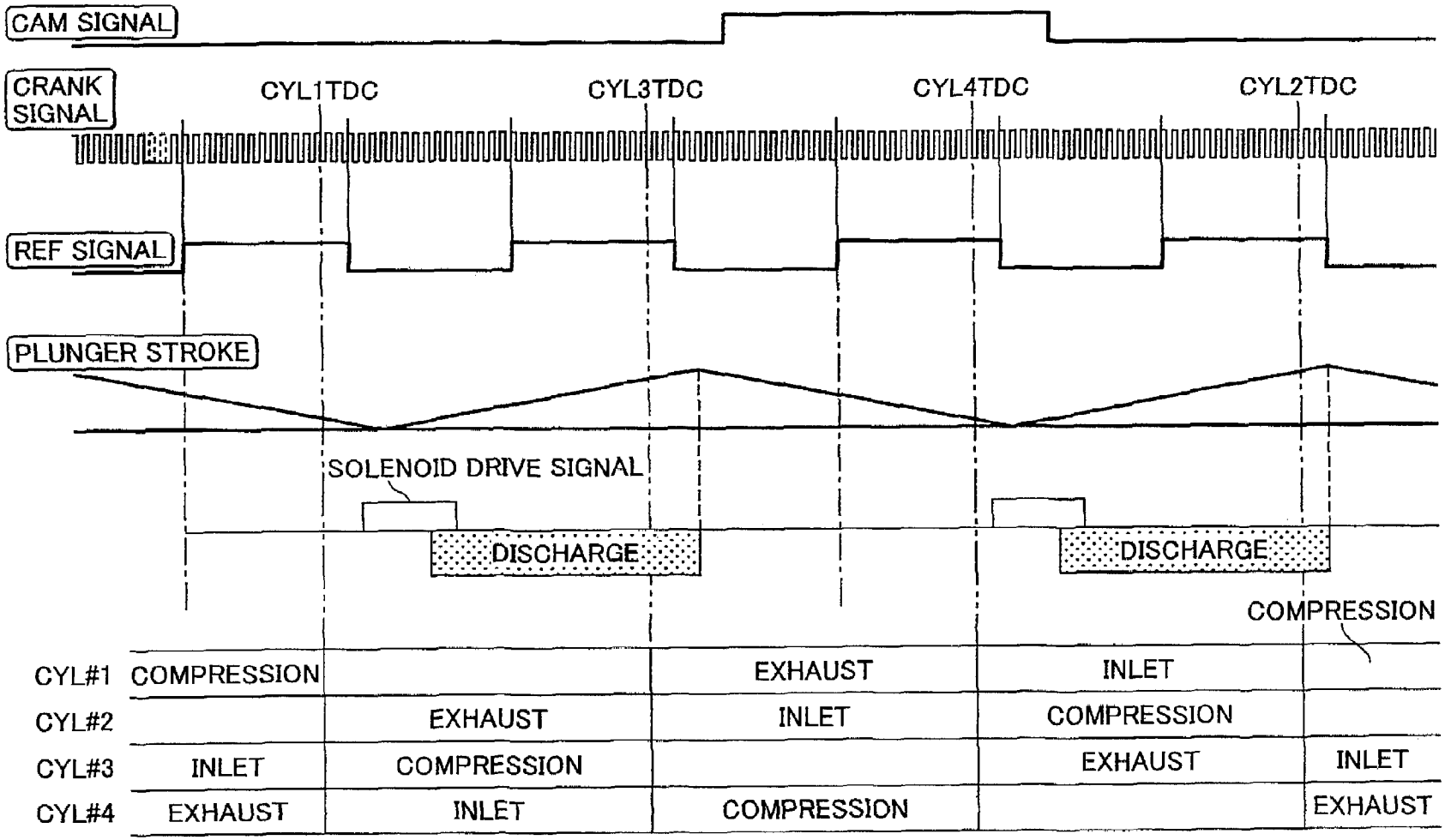
FIG. 9 is a time chart for the high-pressure fuel pump control executed by the control unit.

FIG. 9 is a time chart for the high-pressure fuel pump control executed by the control unit 100. In accordance with a detected signal from the cam angle sensor 36 (i.e., a cam angle signal=CAM signal) and a detected signal from the crank angle sensor 37 (i.e., a crank angle signal=CRANK signal), the control unit 100 detects the top dead center position of the piston 15 in the compression stroke for each of the cylinders #1, #2, #3 and #4 (CYL1, CYL2, CYL3 and CYL4), and then executes fuel injection control and ignition timing control. Further, the control unit 100 detects a stroke of the plunger 62 and executes output control of the drive signal for the solenoid 90 that is an actuator for the high-pressure fuel pump 60. Additionally, the REF signal for use in the high-pressure fuel pump control is produced based on the crank angle signal and the cam angle signal, and rising of the REF signal during the inlet stroke of the high-pressure fuel pump 60, which is present every other REF signal cycle, serves as a reference point. Hereinafter, the rising of the REF signal serving as the reference point will be referred to as "reference REF".

In FIG. 9, a portion where the crank angle signal (CRANK signal) is missing (i.e., a portion indicated by a dotted line) is used as a start point for detecting respective phases of the crank angle signal and the cam angle signal, and it locates in a position shifted from the top dead center of the cylinder #1 (CYL1) or the top dead center of the cylinder #4 (CYL4) by a predetermined phase (i.e., a predetermined crank angle). Then, depending on whether the cam angle signal is Hi (high) or Lo (low) at the time of missing of the crank angle signal, the control unit 100 determines whether the crank angle signal is related to the cylinder #1 (CYL1) side or the cylinder #4 (CYL4), followed by producing an initial REF signal. The fuel discharge from the high-pressure fuel pump 60 is started after the lapse of a predetermined time, which corresponds to the operation delay compensation PUMRE for the solenoid 90, from the rising of the solenoid drive signal. On the other hand, the fuel discharge is continued until the stroke of the plunger 62 reaches the top dead center, because the inlet valve 65 is held in the pressed state (i.e., the closed state) by the pressure in the pressurization chamber 72 even after the outputting of the solenoid drive signal has completed.

Figure 10:
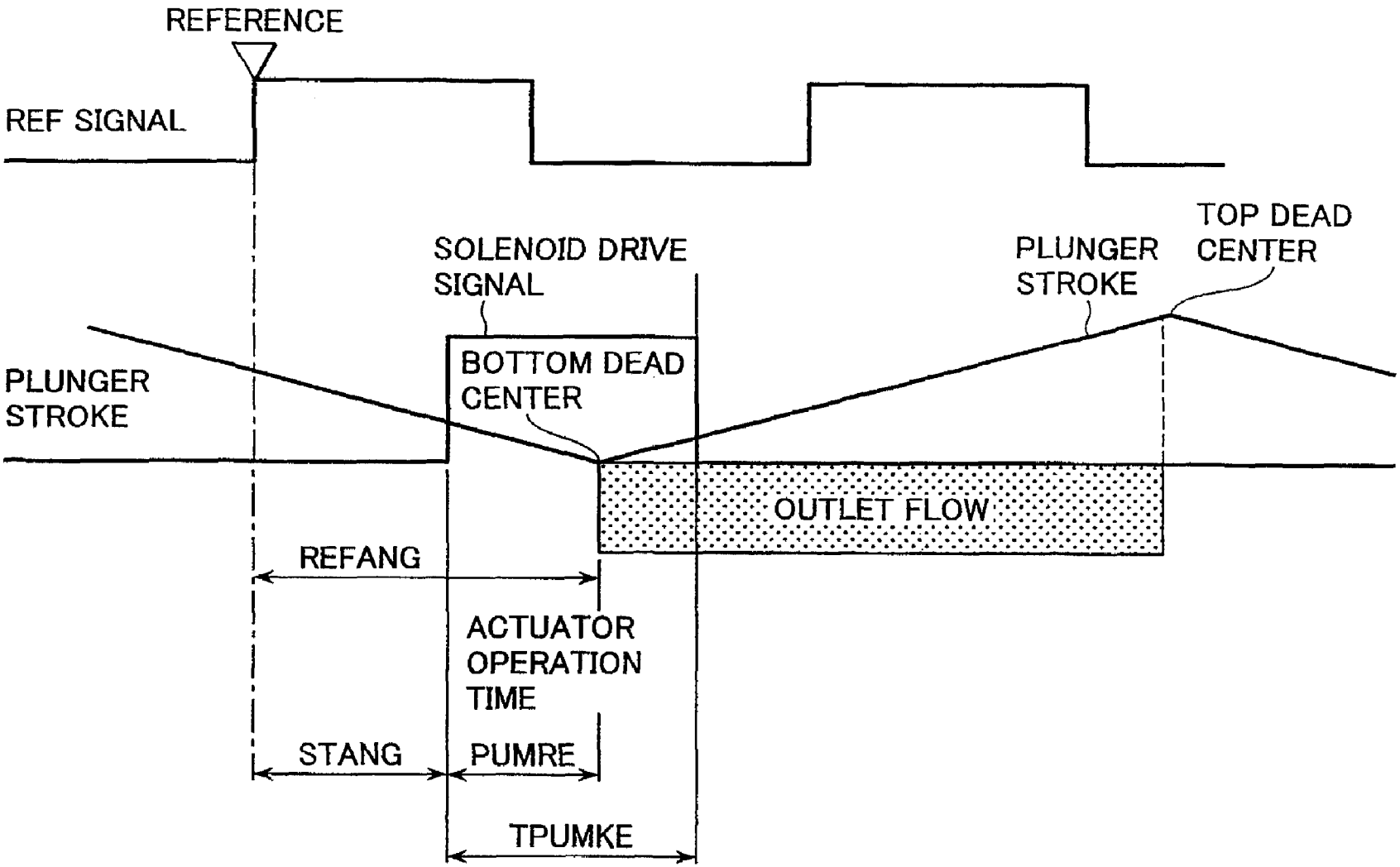
FIG. 10 is a time chart for explaining output control of a solenoid drive signal which is executed by the control unit.

FIG. 10 shows parameters, such as the output start angle STANG of solenoid drive signal and the energization time TPUMKE, which are used in the above-described fuel control. The output start angle STANG representing the output start timing of the solenoid drive signal can be determined from the following formula (1)

$$STANG=REFANG-PUMRE \quad (1)$$

In the formula (1), REFANG is computed by the reference angle computing unit 704 based on the operation status of the engine 10. PUMRE means a pump delay angle computed by the solenoid operation delay compensating unit 705, and it represents an actuator driving time varying with the battery voltage, i.e., an operation delay of the inlet valve actuating member 91 depending on the amount of energization of the solenoid 90. Further, the energization time TPUMKE corresponding to the duration (pulse width) of the drive signal the solenoid 90 is computed based on the battery voltage and the operation status (such as engine RPM).

Then, the output start angle STANG is used to set at what time from the reference REF the solenoid drive signal for closing the inlet valve 65 is outputted, i.e., the output start timing of the solenoid drive signal. Also, the energization time TPUMKE is used to set how long time the solenoid drive signal continues to be outputted, i.e., the pulse width of the solenoid drive signal, namely the output stop timing of the solenoid drive signal. The control of the solenoid 90 based the output start angle STANG is referred to as "basic control" hereafter.

Thus, since the REF signal is essential in the "basic control", control is performed in a mode other than the "basic control" during a period from the operation start to recognition of the initial reference REF. Such control is called here "startup control". One example of the startup control will be described below.

Figure 12:
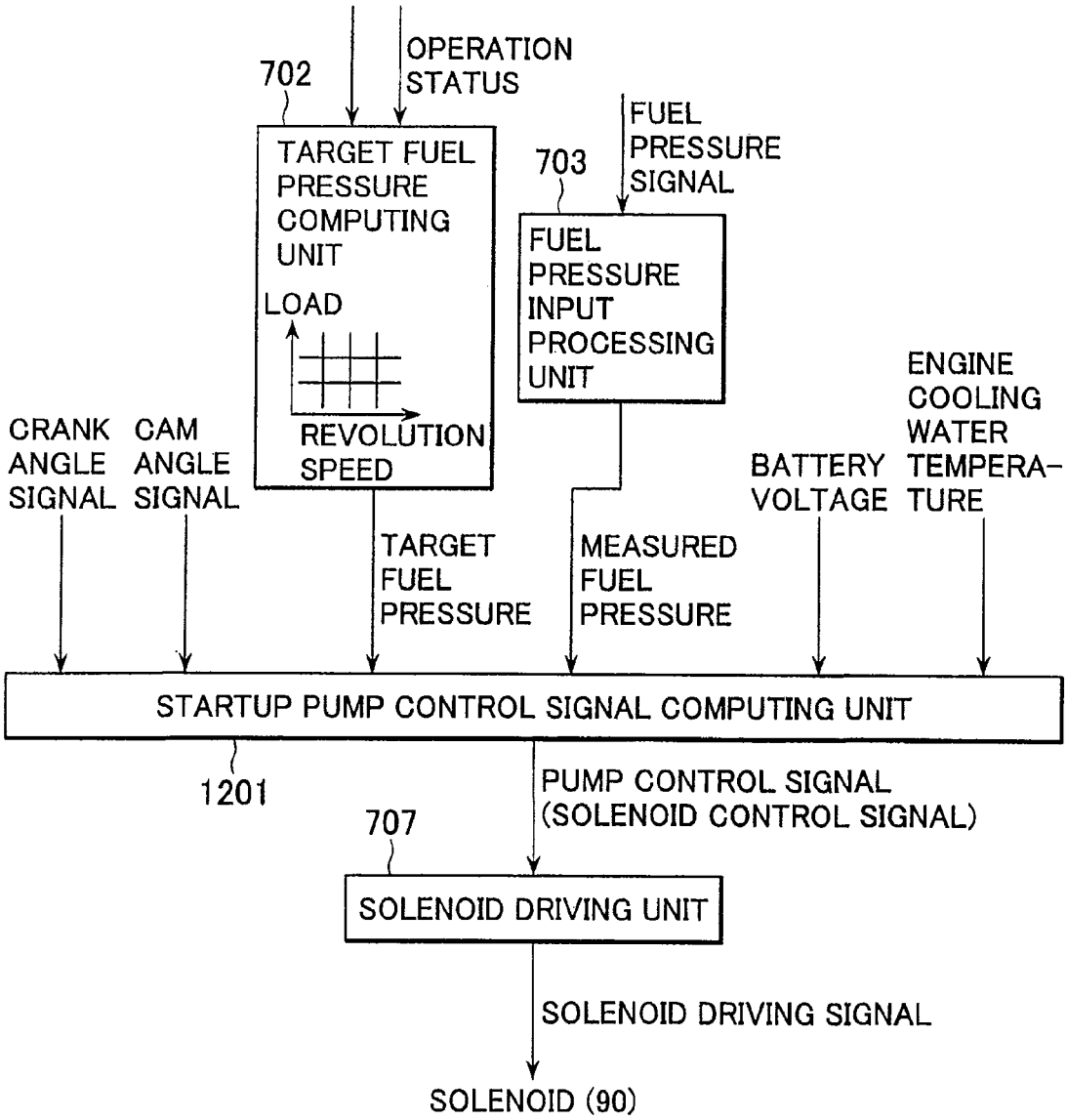
FIG. 12 is a functional block diagram for the high-pressure fuel pump control at startup executed by the control unit.

FIG. 12 is a functional block diagram for one example of the startup control executed by the control unit 100. For executing the startup control, the control unit 100 includes the target fuel pressure computing unit 702, the fuel pressure input processing unit 703, a startup pump control signal computing unit 1201, and the solenoid driving unit 707 for outputting the drive signal to energize the solenoid 90 for excitation.

The startup pump control signal computing unit 1201 computes a solenoid control signal based on the various signals from the crank angle sensor 37, the cam angle sensor 36, the fuel pressure sensor 56, the water temperature sensor 19, etc., and the battery voltage.

Figure 13:
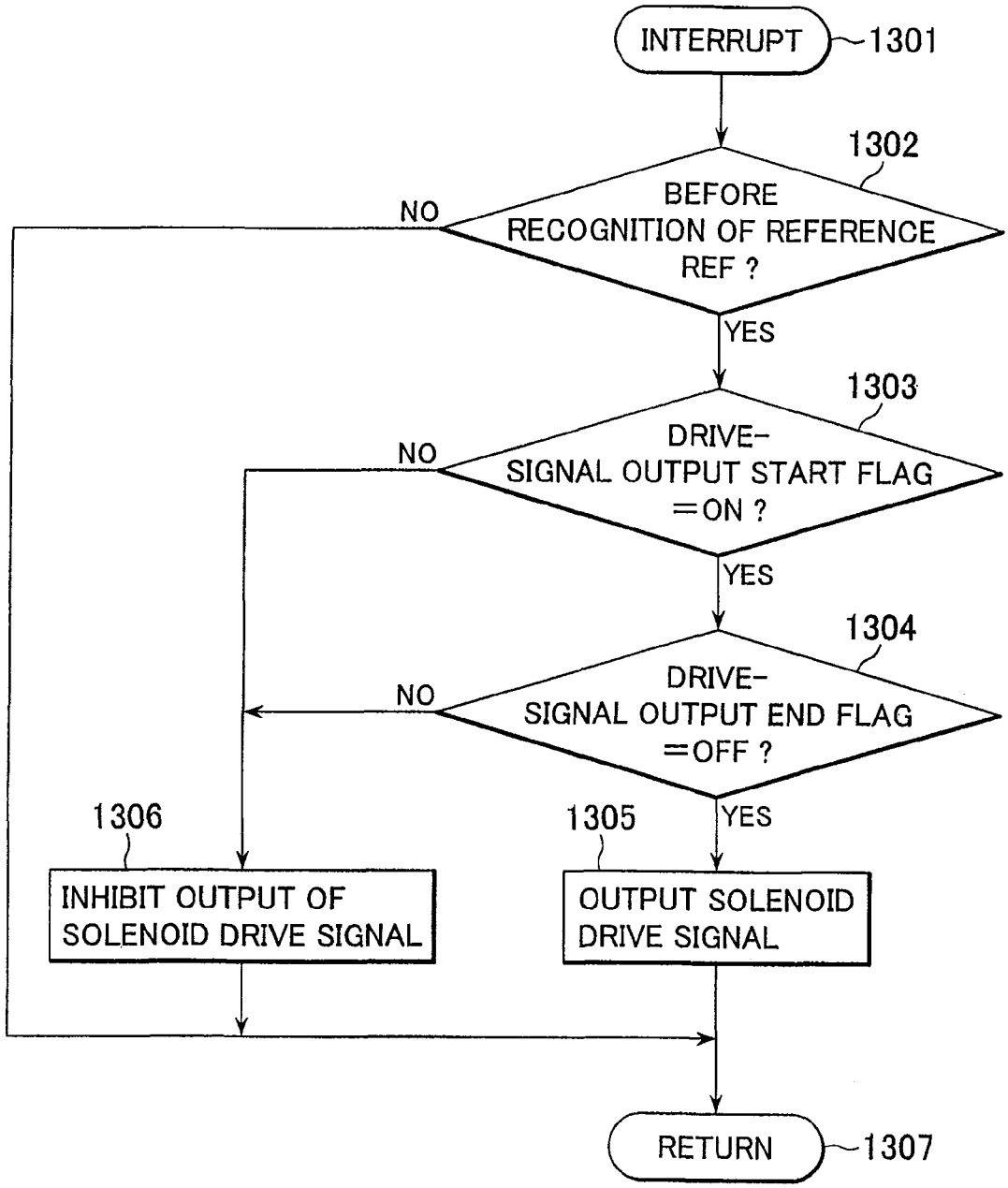
FIG. 13 is a flowchart showing one example of the high-pressure fuel pump control at startup executed by the control unit.

FIG. 13 is a flowchart showing processing executed by the startup pump control signal computing unit 1201 and the solenoid driving unit 707. An interrupt process begins in step 1301. The interrupt process can be executed at a time cycle of, e.g., 10 ms, or a rotation cycle corresponding to each crank angle of, e.g., 10 degrees. In step 1302, it is determined whether the current time is before recognition of the reference REF. If before recognition of the reference REF, the control flow proceeds to step 1303. If after recognition of the reference REF, the control mode is changed to the "basic control" as described above. In step 1303, it is determined whether a drive-signal output start flag is turned on.

Figure 14:
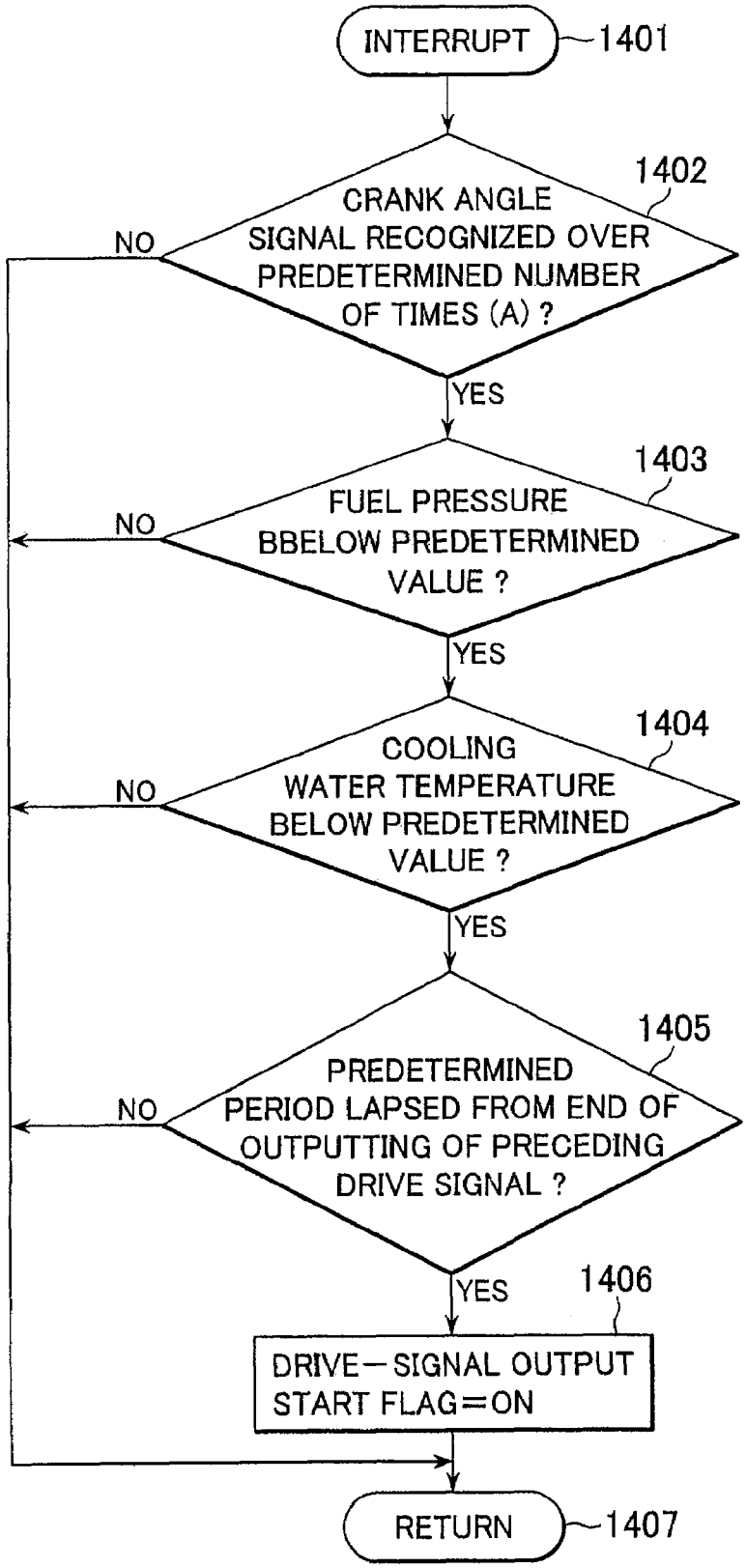
FIG. 14 is a flowchart showing details of a drive-signal output start flag determining process executed in step 1303 of FIG. 13.

FIG. 14 is a flowchart showing a drive-signal output start flag determining process executed in step 1303 described above. The drive-signal output start flag is set to be off at initialization (i.e., at the start of the engine operation), and an interrupt process begins in step 1401. In step 1402, it is determined whether the crank angle signal (pulse) has been recognized in excess of a predetermined number of times (A) from the operation start. This process is to avoid detection of noise incidental to input of the crank angle signal and to prevent a malfunction that may otherwise occur upon power-on of the control unit 100. Accordingly, the predetermined number of times (A) is set to a minimum value within a range not suffering any influence of noise.

In step 1403, it is determined based on the detected signal from the fuel pressure sensor 56 whether the fuel pressure is below a predetermined value. If the fuel pressure is higher than the target fuel pressure, outputting of the drive signal in such a state leads to a possibility that the fuel pressure exceeds the target fuel pressure at the start of the injection, thus resulting in deterioration of the combustion. For that reason, the predetermined value in step 1403 is set to the target fuel pressure. If the fuel pressure is below the predetermined value, the control flow proceeds to step 1404. In step 1404, it is determined whether the cooling water temperature is below a predetermined value. If the cooling water temperature is over the predetermined value, this indicates the solenoid 90 being at a high temperature, and outputting of the drive signal in such a state leads to a possibility that durability of the solenoid 90 deteriorates. While the cooling water temperature is used in this embodiment to estimate the temperature of the solenoid 90, engine oil temperature, fuel temperature or the like may be used instead. Alternatively, the temperature of the solenoid 90 may be detected in a direct manner. If the cooling water temperature is below the predetermined value, the control flow proceeds to step 1405. In step 1405, it is determined whether a predetermined period has lapsed from the output end of the preceding drive signal. If the predetermined period has lapsed, the drive-signal output start flag is turned on.

Figure 16:
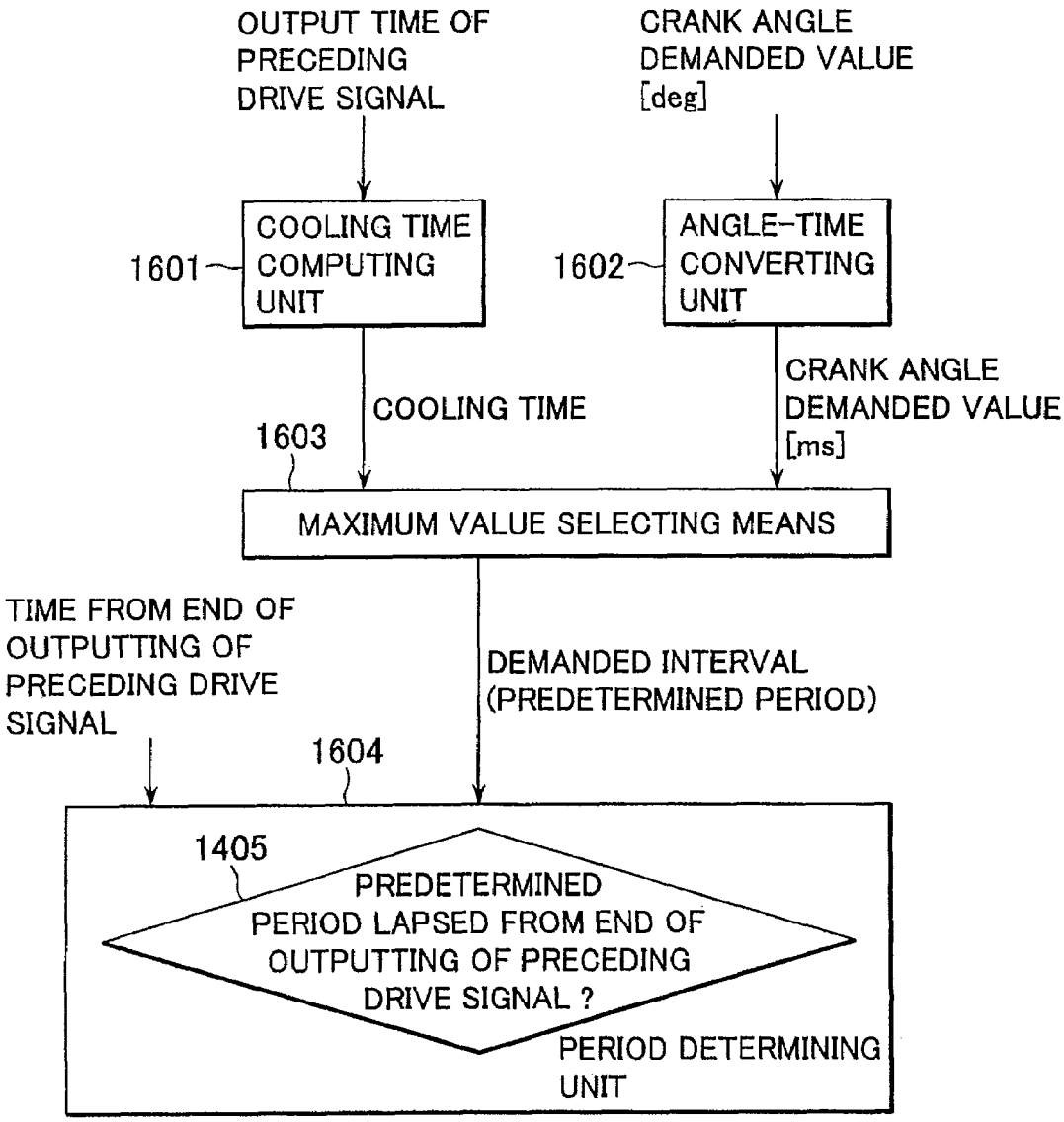
FIG. 16 is a functional block diagram showing a process until reaching determination as to whether a predetermined period has lapsed, which is executed in step 1405 of FIG. 14.
Figure 17:
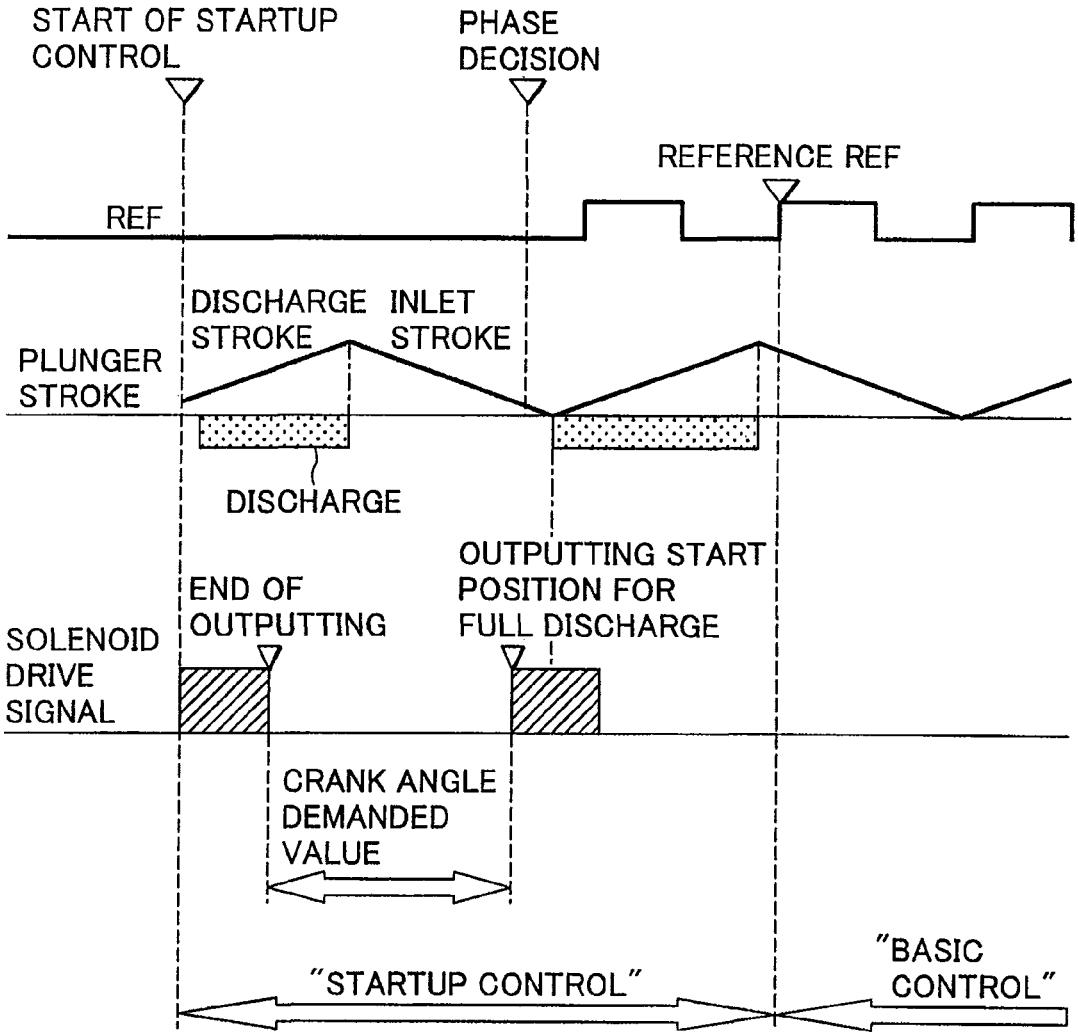
FIG. 17 is a time chart for explaining a crank angle demanded value in FIG. 16.
Figure 18:
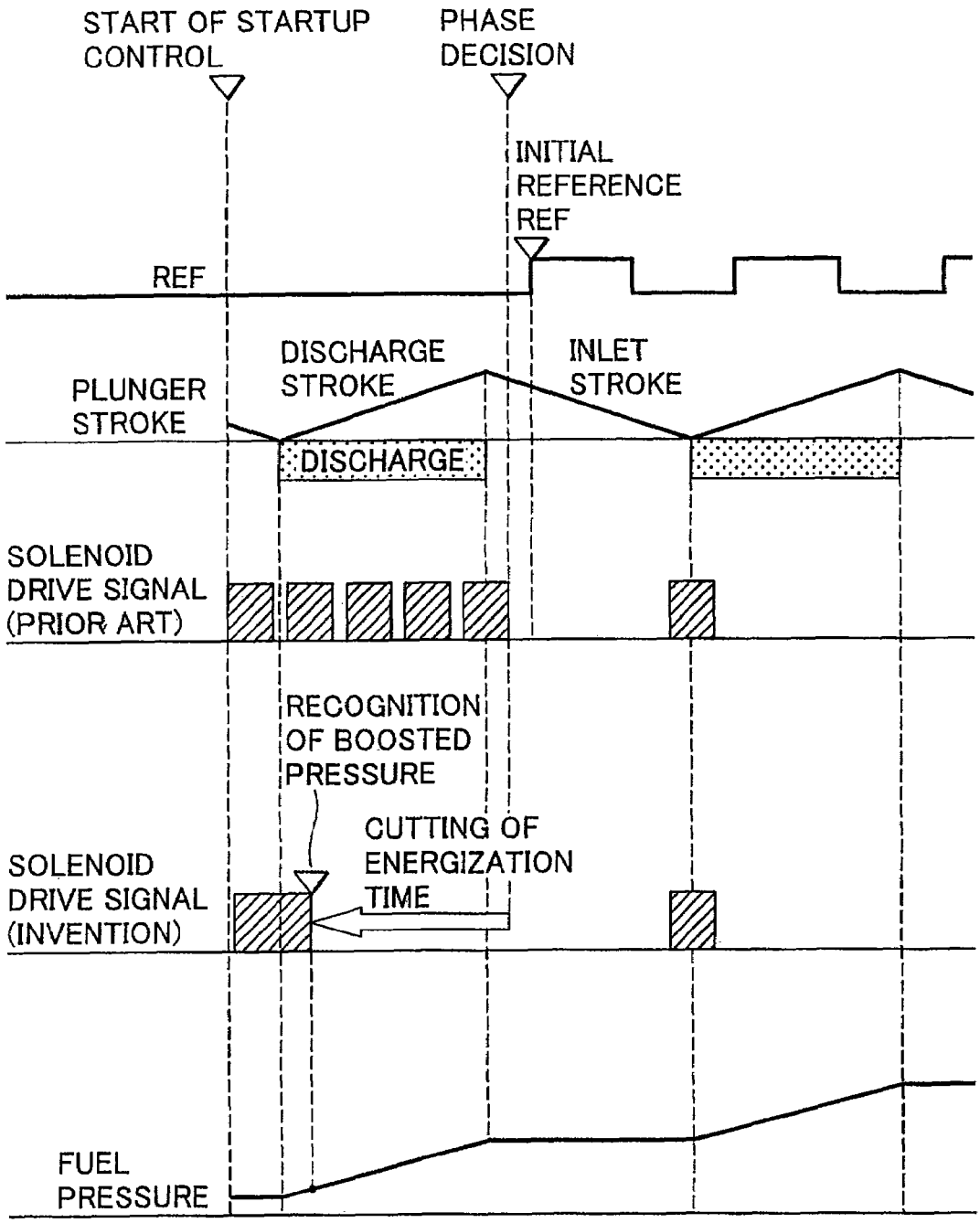
FIG. 18 is a time chart for explaining the operation and advantages of one embodiment of the high-pressure fuel pump control device according to the present invention.

FIG. 16 is a functional block diagram showing a process until reaching the above-described determination as to whether the predetermined period has lapsed. If a period to the next output start of the drive signal is short, the temperature of the solenoid 90 remains at a high level, thus resulting in a possibility that durability of the solenoid 90 deteriorates. For that reason, a certain time for cooling the solenoid 90 is required. Because the time required for cooling the solenoid 90 is in proportion to the temperature of the solenoid 90, i.e., the drive signal output time, a cooling time demanded value is computed based on the preceding drive signal output time given as an input (block 1601). Also, taking into account a possibility that the discharge stroke takes place twice during the period from the operation start to the recognition of the reference REF, the start of outputting of the drive signal must be requested again after the passage of a predetermined crank angle from the output end of the drive signal in a position where the high-pressure fuel pump is able to discharge the fuel with a full stroke. Such a predetermined crank angle is given as a crank angle demanded value (FIG. 17) (block 1602), and this crank angle demanded value is set to a value smaller than the angle corresponding to one reciprocal stroke of the plunger 62. In block 1603, a larger one of the cooling time demanded value and the crank angle demanded value is selected as the above-mentioned predetermined period.

If it is determined in step 1303 of FIG. 13 that the drive-signal output start flag is turned on, the control flow proceeds to step 1304 in which it is determined whether a drive-signal output end flag is turned off.

Figure 15:
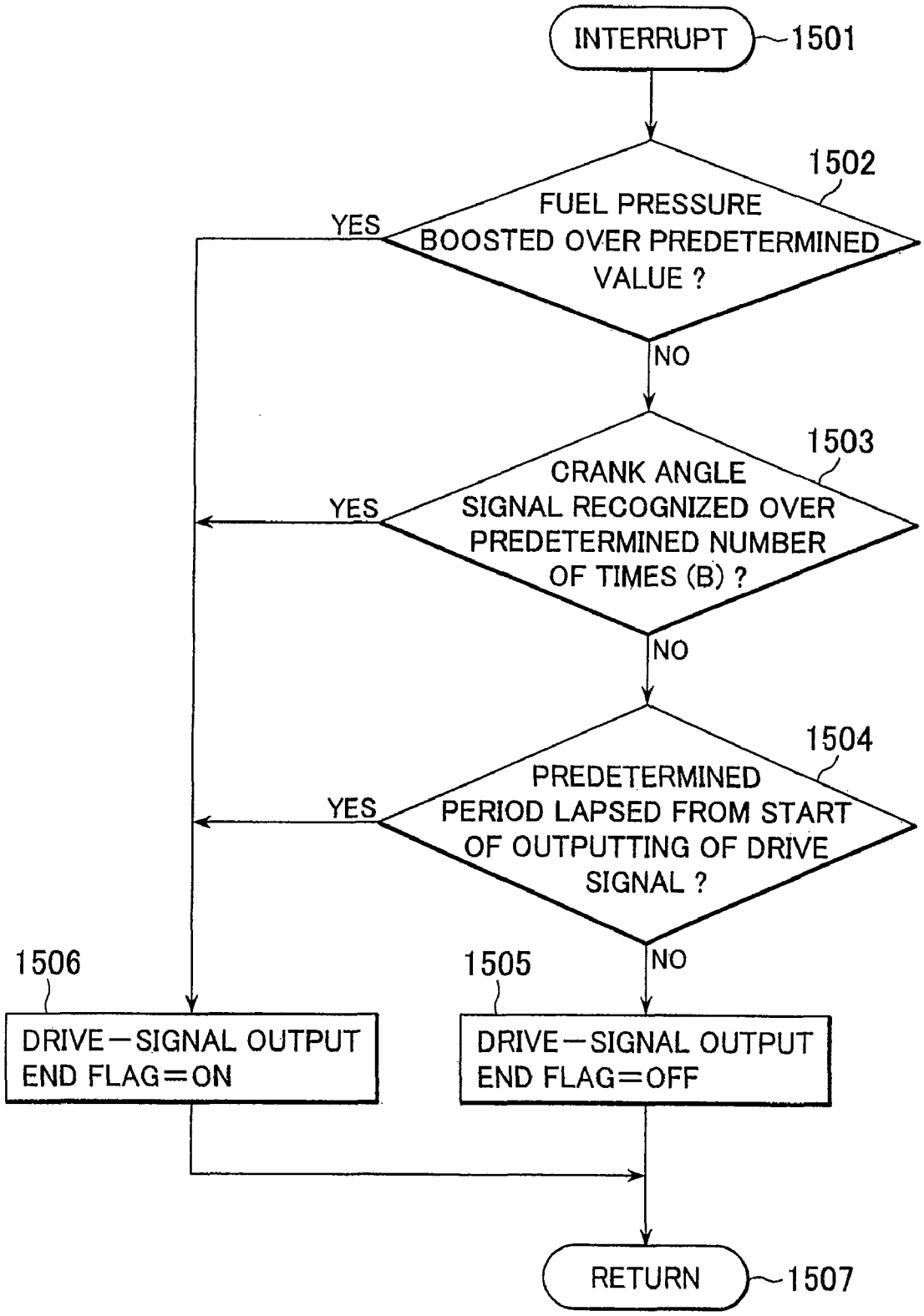
FIG. 15 is a flowchart showing details of a drive-signal output end flag determining process executed in step 1304 of FIG. 13.

FIG. 15 is a flowchart showing a drive-signal output end flag determining process executed in step 1304 described above. The drive-signal output end flag is set to be off at initialization (i.e., at the start of the engine operation), and an interrupt process begins in step 1501. In step 1502, it is determined whether the fuel pressure has boosted over a predetermined value. Whether the fuel pressure has boosted over the predetermined value is determined by storing the fuel pressure before a unit time (e.g., 20 ms) in the RAM 103 and comparing the current fuel pressure with the preceding fuel pressure. If the fuel pressure has boosted over the predetermined value, this indicates that the high-pressure fuel pump 60 has started discharge of the fuel, and therefore the drive-signal output end flag is turned on. The above-mentioned predetermined value is set to such a value as enabling the inlet valve 65 to be held in the closed state even after the outputting of the drive signal has completed.

In next step 1503, it is determined whether the crank angle signal (pulse) has been recognized in excess of a predetermined number of times (B) from the operation start. This process is intended to end the outputting of the drive signal when the pressure boosting cannot be detected due to the presence of air bubbles in the common rail 53 or other reasons in spite of the high-pressure fuel pump 60 having started discharge of the fuel in step 1502. In step 1504, it is determined whether a predetermined period has lapsed from the output start of the drive signal. This process is intended to end the outputting of the drive signal when the engine stalls, the fuel pressure does not boost, and the crank angle signal is stopped before recognition of the reference REF. Accordingly, the predetermined period from the output start of the drive signal is set to the longest time required for recognition of the reference REF.

If it is determined in step 1304 of FIG. 13 that the drive-signal output end flag is turned off, the control flow proceeds to step 1305 in which the solenoid drive signal is outputted. The signal outputted at this time is given as a continuous signal (duty 100%). This is intended to prevent a trouble as follows. When, after starting energization of the solenoid 90, the energization is stopped before the pressure in the pressurization chamber 72 has boosted, there is a risk that the inlet valve 65 cannot be positively closed. In such an event, the inlet valve 65 is left open and the high-pressure fuel is not discharged to the common rail 53 side.

Further, if it is determined in step 1303 that the drive-signal output start flag is turned off, and if it is determined in step 1304 that the drive-signal output end flag is turned on, the outputting of the solenoid drive signal is inhibited (stopped).

With this embodiment described above, as shown in a time chart of FIG. 18, the outputting of the solenoid drive signal is started during the period from the operation start to the recognition of the reference REF, i.e., during the period from the operation start to the point in time at which it becomes possible to output the solenoid drive signal in the predetermined crank angle phase. Also, when the fuel pressure in the common rail 53 has boosted over the predetermined value per unit time, the outputting of the solenoid drive signal is stopped. Therefore, the fuel pressure can be positively boosted to the required level, and satisfactory combustion is realized with improved robustness. Further, a total energization time of the solenoid 90 during the period from the operation start to the recognition of the reference REF can be cut as compared with the known techniques. It is hence possible to increase durability of the high-pressure fuel pump 60 and to reduce current consumption.

While, in the above-described embodiment, the timing of stopping the outputting of the solenoid drive signal is set to the point in time at which the fuel pressure in the common rail 53 has boosted over the predetermined value per unit time, the output stop timing may be instead set to, for example, the point in time at which a pressure difference with respect to the pressure at the operation start has exceeded a predetermined value.

Figure 19:
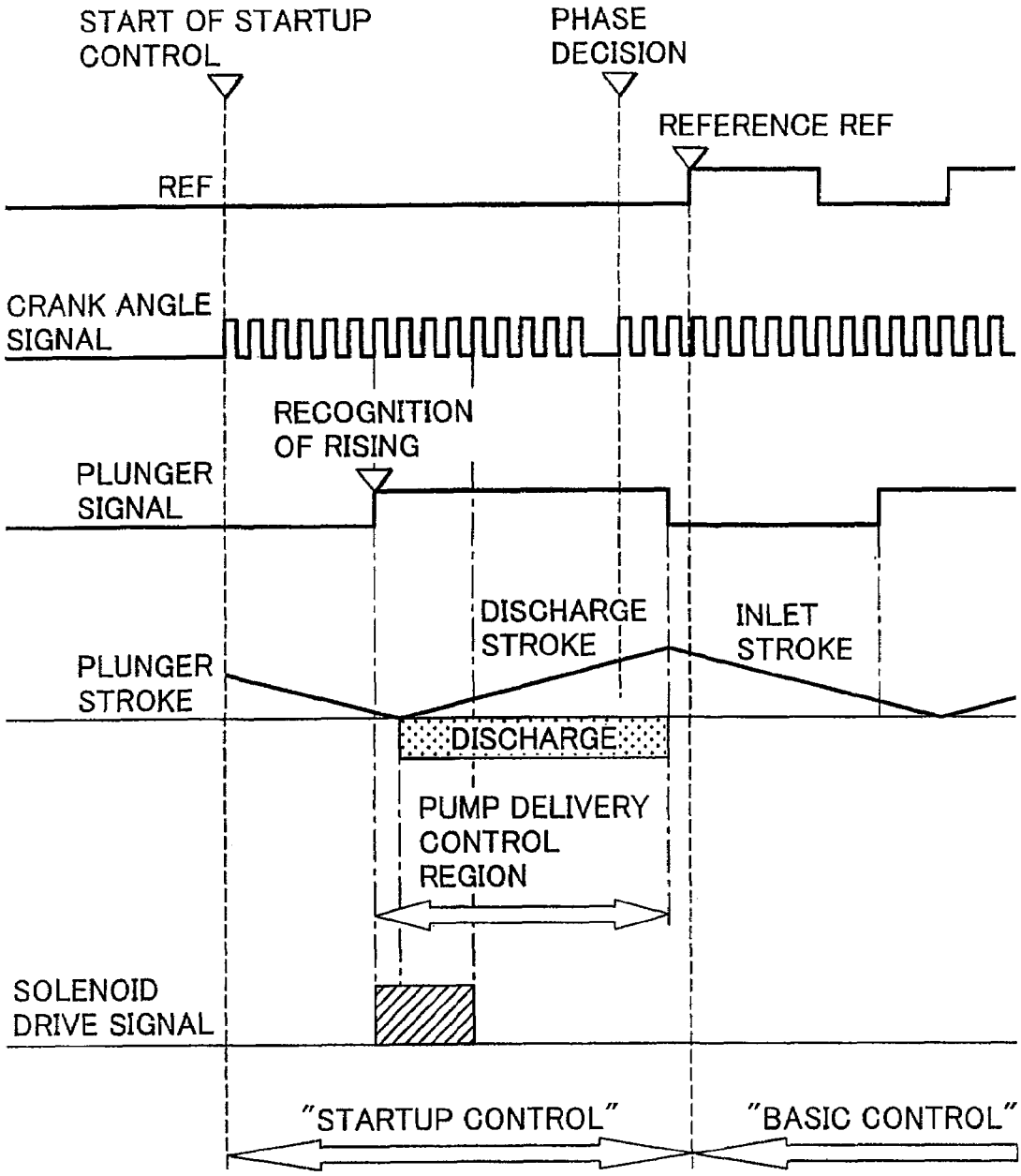
FIG. 19 is a time chart for explaining the operation and advantages of another embodiment of the high-pressure fuel pump control device according to the present invention.

Another embodiment of the high-pressure fuel pump control unit according to the present invention, in particular, one example of the startup control executed therein, will be described below with reference to FIG. 19. In this embodiment, a plunger signal for setting a high-pressure-fuel-pump discharge control region start angle (timing) and a high-pressure-fuel-pump discharge control region end angle (timing) is produced based on the signals from the crank angle sensor 37 and the cam angle sensor 36 in the above-described embodiment shown in FIG. 1.

The driving control of the solenoid 90 is executed, as mentioned above, taking into account the operation delay of the solenoid 90 and the operation delay of the inlet valve actuating member 91 resulting from the former. Therefore, the term "high-pressure-fuel-pump discharge control region" is defined as a region from an angle preceding the operation delay of the inlet valve actuating member 91 before the bottom dead center of the plunger 62 to the top dead center of the plunger 62. When the high-pressure-fuel-pump discharge control region start angle (timing) is recognized during the "startup control", the outputting of the solenoid drive signal is started and continued for the energization time TPUMKE of the solenoid 90, thereby boosting the pressure. As the energization time, the crank angle corresponding to TPUMKE may also be used in place of TRUKE.

In comparison with the above-described embodiment in which the output start timing of the solenoid drive signal is set to the operation start timing, according to this embodiment, the output start timing is delayed from the operation start timing. It is therefore possible to further cut the total energization time of the solenoid 90, increase durability of the high-pressure fuel pump 60, and reduce current consumption.

While the embodiments of the present invention have been fully described above, the present invention is not limited to the above-described embodiments and can be variously modified in design without departing from the spirit of the present invention set forth in the attached claims.

For example, although the high-pressure fuel pump 60 is driven by the exhaust camshaft 49 in the above-described embodiments, it may be driven by the intake camshaft 29 or the crankshaft 18.

What is claimed is:

1. A high-pressure fuel pump control device for an engine comprising:

a fuel injector valve for directly injecting fuel in a common rail into a combustion chamber; and a high-pressure fuel pump for feeding the fuel under pressure to said common rail;

wherein said high-pressure fuel pump comprises:

a pressurization chamber;

a plunger for pressurizing fuel in said pressurization chamber;

a fuel passage valve disposed in said pressurization chamber; and an actuator for actuating said fuel passage valve;

wherein said control device includes control means for executing output control of a drive signal for said actuator to vary a discharge rate of said high-pressure fuel pump; and wherein said control means starts outputting the actuator drive signal, during a period from operation start to a point in time at which the actuator drive signal becomes able to issue in a predetermined crank angle phase, when a crank angle signal has been recognized in excess of at least two times from the operation start.

2. A high-pressure fuel pump control device for an engine according to claim 1, wherein said control means starts outputting the actuator drive signal when the fuel pressure in said common rail is below a predetermined value.

3. A high-pressure fuel pump control device for an engine according to claim 1, wherein said control means starts outputting the actuator drive signal when temperature of the engine cooling water is below a predetermined value.

4. A high-pressure fuel pump control device for an engine according to claim 1, wherein said control means starts outputting the actuator drive signal when a predetermined period has lapsed from stop of the preceding outputting of the actuator drive signal.

5. A high-pressure fuel pump control device for an engine according to claim 4, wherein said control means sets said predetermined period based on a preceding output time of at least one of the actuator drive signal and a crank angle demanded value.

6. A high-pressure fuel pump control device for an engine according to claim 1, wherein said control means starts outputting the actuator drive signal based on the crank angle signal or a cam angle signal which indicates a discharge range of said high-pressure fuel pump.

7. A high-pressure fuel pump control device for an engine comprising:

a fuel injector valve for directly injecting fuel in a common rail into a combustion chamber; and a high-pressure fuel pump for feeding the fuel under pressure to said common rail;

wherein said high-pressure fuel pump comprises:

a pressurization chamber;

a plunger for pressurizing fuel in said pressurization chamber;

a fuel passage valve disposed in said pressurization chamber; and an actuator for actuating said fuel passage valve;

wherein said control device includes control means for executing output control of a drive signal for said actuator to vary a discharge rate of said high pressure fuel pump; and wherein said control means starts outputting the actuator drive signal during a period from operation start to a point in time at which the actuator drive signal becomes able to issue in a predetermined crank angle phase after operation start, and sets timing of stopping the outputting of the actuator drive signal based on fuel pressure in said common rail.

8. A high-pressure fuel pump control device for an engine according to claim 7, wherein said control means starts outputting the actuator drive signal when the fuel pressure in said common rail is below a predetermined value.

9. A high-pressure fuel pump control device for an engine according to claim 7, wherein said control means starts outputting the actuator drive signal when temperature of the engine cooling water is below a predetermined value.

10. A high-pressure fuel pump control device for an engine according to claim 7, wherein said control means starts outputting the actuator drive signal when a predetermined period has lapsed from stop of the preceding outputting of the actuator drive signal.

11. A high-pressure fuel pump control device for an engine according to claim 10, wherein said control means sets said predetermined period based on a preceding output time of at least one of the actuator drive signal and a crank angle demanded value.

12. A high-pressure fuel pump control device for an engine according to claim 7, wherein said control means starts outputting the actuator drive signal based on the crank angle signal or a cam angle signal which indicates a discharge range of said high-pressure fuel pump.

13. A high-pressure fuel pump control device for an engine according to claim 1, wherein said control means starts outputting of the actuator drive signal when temperature of the engine oil is below a predetermined value.

14. A high-pressure fuel pump control device for an engine according to claim 1, wherein said control means starts outputting of the actuator drive signal when temperature of the fuel is below a predetermined value.

15. A high-pressure fuel pump control device for an engine according to claim 1, wherein said control means starts outputting of the actuator drive signal when a temperature of a solenoid of the plunger is below a predetermined value.

* * * * *